US010017295B2

(12) United States Patent
Chasteen et al.

(10) Patent No.: US 10,017,295 B2
(45) Date of Patent: Jul. 10, 2018

(54) CONTAINER END CLOSURE WITH OPTIONAL SECONDARY VENT OPENING

(71) Applicant: Ball Corporation, Broomfield, CO (US)

(72) Inventors: Howard C. Chasteen, Westminster, CO (US); Mark A. Jacober, Arvada, CO (US)

(73) Assignee: Ball Corporation, Broomfield, CO (US)

( * ) Notice: Subject to any disclaimer, the term of this patent is extended or adjusted under 35 U.S.C. 154(b) by 474 days.

(21) Appl. No.: 14/812,146

(22) Filed: Jul. 29, 2015

(65) Prior Publication Data

US 2015/0329238 A1 Nov. 19, 2015

Related U.S. Application Data

(63) Continuation-in-part of application No. 14/066,457, filed on Oct. 29, 2013, now Pat. No. 9,446,879, which is a continuation of application No. 12/851,979, filed on Aug. 6, 2010, now Pat. No. 8,567,158.

(60) Provisional application No. 62/039,020, filed on Aug. 19, 2014.

(51) Int. Cl.

| | |
|---|---|
| ***B65D 17/42*** | (2006.01) |
| ***B65D 17/28*** | (2006.01) |
| ***B65D 47/32*** | (2006.01) |
| ***B65B 69/00*** | (2006.01) |

(52) U.S. Cl.

CPC ..... *B65D 17/4012* (2018.01); *B65B 69/00* (2013.01); *B65D 47/32* (2013.01); *B65D 2517/002* (2013.01); *B65D 2517/0013* (2013.01); *B65D 2517/0014* (2013.01); *B65D 2517/0094* (2013.01)

(58) Field of Classification Search

CPC ..... B65D 17/36; B65D 17/42; B65D 51/002; B65D 17/404; B65D 17/4011; B65D 17/4012; B65D 2517/0002

USPC ..... 220/269, 255

See application file for complete search history.

(56) References Cited

U.S. PATENT DOCUMENTS

| | | | |
|---|---|---|---|
| 1,847,794 | A | 3/1932 | Takeda |
| 2,160,429 | A | 5/1939 | Bukolt |
| 2,272,111 | A | 2/1942 | Dove |
| 3,169,678 | A | 2/1965 | Wilkinson |
| 3,215,305 | A | 11/1965 | Frankenberg |
| 3,227,304 | A | 1/1966 | Asbury |

(Continued)

FOREIGN PATENT DOCUMENTS

| | | |
|---|---|---|
| AU | 2016204140 | 8/2016 |
| CA | 2280461 | 2/2001 |

(Continued)

OTHER PUBLICATIONS

U.S. Appl. No. 14/877,743, filed Oct. 7, 2015, Jacober et al.

(Continued)

*Primary Examiner* — Gloria R Weeks

(74) *Attorney, Agent, or Firm* — Sheridan Ross P.C.

(57) ABSTRACT

The present invention relates to an opening device for a beverage container. More specifically, the invention relates to a metal end closure having a primary opening area and at least one optional secondary vent opening which can be opened with the same pull tab. The primary opening area and the secondary vent opening area are defined by a score line which is interrupted by a check slot to inhibit propagation of a fracture along the score line.

20 Claims, 16 Drawing Sheets

(56) References Cited

U.S. PATENT DOCUMENTS

| | | | |
|---|---|---|---|
| 3,246,791 | A | 4/1966 | Asbury |
| 3,262,611 | A | 7/1966 | Palmer |
| 3,307,737 | A | 3/1967 | Harvey et al. |
| 3,326,406 | A | 6/1967 | Brown |
| D208,591 | S | 9/1967 | Bozek |
| 3,362,569 | A | 1/1968 | Geiger |
| 3,370,169 | A | 2/1968 | Bozek |
| 3,441,169 | A | 4/1969 | Dunn et al. |
| 3,442,416 | A | 5/1969 | Nicholson |
| 3,446,389 | A | 5/1969 | Brown |
| 3,499,573 | A | 3/1970 | Adams |
| 3,618,815 | A | 11/1971 | Heffner |
| 3,731,836 | A | 5/1973 | Silver |
| 3,741,432 | A | 6/1973 | Werth et al. |
| 3,744,667 | A | 7/1973 | Fraze et al. |
| 3,762,597 | A | 10/1973 | Kaminski et al. |
| 3,765,208 | A | 10/1973 | Cozert |
| 3,779,417 | A | 12/1973 | Klein |
| 3,794,206 | A | 2/1974 | De Line et al. |
| 3,826,401 | A | 7/1974 | Zundel |
| 3,833,144 | A | 9/1974 | Bollmann et al. |
| 3,836,038 | A | 9/1974 | Cudzik |
| 3,856,184 | A | 12/1974 | Luviano |
| 3,877,604 | A | 4/1975 | Brown |
| 3,877,606 | A | 4/1975 | Silver |
| 3,881,630 | A | 5/1975 | Lovell et al. |
| 3,908,856 | A | 9/1975 | Perry |
| D238,150 | S | 12/1975 | Cudzik |
| D238,659 | S | 2/1976 | Wallace |
| D239,255 | S | 3/1976 | Brincks et al. |
| D239,256 | S | 3/1976 | Brincks et al. |
| RE28,910 | E | 7/1976 | Dalli et al. |
| 3,970,212 | A | 7/1976 | Brown |
| 3,982,657 | A | 9/1976 | Keller et al. |
| 4,024,981 | A | 5/1977 | Brown |
| 4,030,631 | A | 6/1977 | Brown |
| 4,032,034 | A | 6/1977 | Willis |
| 4,039,100 | A | 8/1977 | Wells |
| 4,051,976 | A | 10/1977 | Perry |
| 4,054,228 | A | 10/1977 | Balocca et al. |
| 4,061,243 | A | 12/1977 | Khoury |
| 4,062,471 | A | 12/1977 | Perry et al. |
| 4,073,403 | A | 2/1978 | Orange |
| 4,084,721 | A | 4/1978 | Perry |
| 4,105,133 | A | 8/1978 | La Barge et al. |
| 4,128,186 | A | 12/1978 | Gane |
| 4,146,149 | A | 3/1979 | Beveridge |
| 4,148,410 | A | 4/1979 | Brown |
| 4,184,607 | A | 1/1980 | Potts |
| 4,196,823 | A | 4/1980 | Madden et al. |
| D255,423 | S | 6/1980 | Bathurst |
| D255,424 | S | 6/1980 | Bathurst |
| D255,425 | S | 6/1980 | Bathurst |
| 4,205,760 | A | 6/1980 | Hasegawa |
| RE30,349 | E | 7/1980 | Silver |
| 4,210,257 | A | 7/1980 | Radtke |
| 4,213,538 | A | 7/1980 | Boardman |
| 4,244,489 | A | 1/1981 | Klein |
| 4,244,490 | A | 1/1981 | Klein |
| 4,252,247 | A | 2/1981 | Asbury |
| 4,257,529 | A | 3/1981 | Saunders |
| 4,267,938 | A | 5/1981 | Debenham et al. |
| D259,403 | S | 6/1981 | Frazier |
| 4,276,993 | A | 7/1981 | Hasegawa |
| 4,280,427 | A | 7/1981 | Potts |
| 4,289,251 | A | 9/1981 | Maliszewski |
| 4,305,523 | A | 12/1981 | Dalli et al. |
| 4,318,494 | A | 3/1982 | Heyn |
| 4,320,850 | A | 3/1982 | Drolen, Jr. |
| 4,361,251 | A | 11/1982 | Langseder et al. |
| D267,633 | S | 1/1983 | Christian |
| 4,387,827 | A | 6/1983 | Ruemer, Jr. |
| 4,397,403 | A | 8/1983 | Guimarin |
| 4,402,421 | A | 9/1983 | Ruemer, Jr. |
| 4,416,389 | A | 11/1983 | Wilkinson et al. |
| 4,417,668 | A | 11/1983 | Stolle |
| D271,857 | S | 12/1983 | Callahan |
| 4,438,865 | A | 3/1984 | Scattaregia |
| 4,448,325 | A | 5/1984 | Edwards et al. |
| 4,465,204 | A | 8/1984 | Kaminski et al. |
| 4,576,305 | A | 3/1986 | Saunders |
| 4,576,306 | A | 3/1986 | Kelsey et al. |
| 4,701,090 | A | 10/1987 | Smith |
| 4,901,880 | A | 2/1990 | Tatham et al. |
| 4,930,658 | A | 6/1990 | McEldowney |
| 4,994,009 | A | 2/1991 | McEldowney |
| 5,007,554 | A | 4/1991 | Hannon et al. |
| 5,011,037 | A | 4/1991 | Moen et al. |
| 5,064,087 | A | 11/1991 | Koch |
| 5,065,882 | A | 11/1991 | Sugiyama |
| 5,129,541 | A | 7/1992 | Voigt et al. |
| 5,131,555 | A | 7/1992 | DeMars et al. |
| 5,145,086 | A | 9/1992 | Krause |
| 5,190,149 | A | 3/1993 | Krause |
| 5,219,257 | A | 6/1993 | Kock |
| 5,224,618 | A | 7/1993 | Garbiso |
| 5,248,053 | A | 9/1993 | Lundgren |
| 5,285,919 | A | 2/1994 | Recchia |
| 5,307,947 | A | 5/1994 | Moen et al. |
| D353,769 | S | 12/1994 | Miller |
| 5,375,729 | A | 12/1994 | Schubert |
| 5,397,014 | A | 3/1995 | Aydt |
| 5,405,039 | A | 4/1995 | Komura |
| 5,456,378 | A | 10/1995 | DeMars |
| 5,494,184 | A | 2/1996 | Noguchi et al. |
| 5,555,992 | A | 9/1996 | Sedgeley |
| D382,481 | S | 8/1997 | McEldowney |
| 5,653,355 | A | 8/1997 | Tominaga et al. |
| 5,655,678 | A | 8/1997 | Kobayashi |
| D385,192 | S | 10/1997 | Hurst et al. |
| 5,683,006 | A | 11/1997 | Cook, III |
| D387,987 | S | 12/1997 | Neiner |
| 5,692,636 | A | 12/1997 | Schubert |
| 5,695,085 | A | 12/1997 | Hadener |
| 5,711,448 | A | 1/1998 | Clarke, III |
| 5,713,481 | A | 2/1998 | Jordan |
| 5,715,964 | A | 2/1998 | Turner et al. |
| D396,635 | S | 8/1998 | McEldowney |
| D397,296 | S | 8/1998 | McEldowney et al. |
| 5,819,973 | A | 10/1998 | Traub, Sr. et al. |
| D402,555 | S | 12/1998 | McEldowney et al. |
| D402,887 | S | 12/1998 | Hurst |
| 5,860,553 | A | 1/1999 | Schubert |
| 5,911,331 | A | 6/1999 | Boller |
| 5,938,390 | A | 8/1999 | Jordan |
| D415,026 | S | 10/1999 | Turner et al. |
| 5,964,366 | A | 10/1999 | Hurst et al. |
| 5,975,327 | A | 11/1999 | Funk |
| 5,979,697 | A | 11/1999 | Kim |
| 6,024,239 | A | 2/2000 | Turner et al. |
| 6,050,440 | A | 4/2000 | McEldowney |
| D424,438 | S | 5/2000 | Turner et al. |
| 6,059,137 | A | 5/2000 | Westwood et al. |
| 6,062,414 | A | 5/2000 | Mongarli et al. |
| 6,079,583 | A | 6/2000 | Chasteen |
| 6,131,763 | A | 10/2000 | Stanish et al. |
| 6,145,866 | A | 11/2000 | Peter |
| D434,983 | S | 12/2000 | Hurst |
| 6,161,717 | A | 12/2000 | Forrest et al. |
| 6,202,880 | B1 | 3/2001 | Strube et al. |
| D448,666 | S | 10/2001 | Fields |
| 6,330,954 | B1 | 12/2001 | Turner et al. |
| 6,354,453 | B1 | 3/2002 | Chasteen |
| 6,375,029 | B2 | 4/2002 | Anthony et al. |
| 6,499,329 | B1 | 12/2002 | Enoki et al. |
| D476,889 | S | 7/2003 | Fields |
| 6,715,629 | B2 | 4/2004 | Hartman et al. |
| 6,761,281 | B2 | 7/2004 | Hartman |
| 6,837,093 | B2 | 1/2005 | Yamasaki |
| 7,000,797 | B2 | 2/2006 | Forrest et al. |
| 7,096,759 | B2 | 8/2006 | Kirko |
| 7,100,789 | B2 | 9/2006 | Nguyen et al. |
| D535,561 | S | 1/2007 | Smith et al. |
| D559,680 | S | 1/2008 | Jacober et al. |

(56) References Cited

U.S. PATENT DOCUMENTS

D579,771 S 11/2008 Cherian
7,506,779 B2 3/2009 Jentzsch et al.
7,513,383 B2 4/2009 Hwang
7,516,869 B1 4/2009 Hajianpour
D600,116 S 9/2009 Cherian
D602,776 S 10/2009 Cherian
D612,724 S 3/2010 Cherian
7,748,557 B2 7/2010 Robinson
D623,963 S 9/2010 Fairchild et al.
7,891,519 B2 2/2011 Matsukawa et al.
7,918,359 B2 4/2011 Paris et al.
7,975,884 B2 7/2011 Mathabel et al.
D650,276 S 12/2011 Nesling et al.
D650,277 S 12/2011 Nesling et al.
D650,278 S 12/2011 Nesling et al.
D653,538 S 2/2012 Toms et al.
D653,944 S 2/2012 Seki et al.
8,136,689 B2 3/2012 Ulstein et al.
8,152,016 B2 4/2012 Berndt et al.
8,177,092 B2 5/2012 Mills
8,245,866 B2 8/2012 Gibson et al.
8,336,726 B2 12/2012 Ramsey et al.
8,397,935 B2 3/2013 Emanuele, III et al.
D691,039 S 10/2013 Jacober et al.
8,567,158 B2 10/2013 Chasteen et al.
8,573,432 B2 11/2013 Emanuele, III et al.
8,627,979 B2 1/2014 Thibaut et al.
8,646,643 B2 2/2014 Forrest et al.
D704,555 S 5/2014 Hernandez
D715,144 S 10/2014 Scott
D715,647 S 10/2014 Jacober et al.
8,893,913 B2 11/2014 McClung et al.
8,939,306 B2 1/2015 Rios
8,939,308 B2 1/2015 Ramsey et al.
8,950,619 B2 2/2015 Bork
8,978,915 B2 3/2015 Burleson, Jr.
D727,725 S 4/2015 Jacober et al.
8,998,015 B2 4/2015 Williams et al.
9,016,504 B2 4/2015 McClung et al.
9,033,174 B2 5/2015 Chasteen et al.
D731,887 S 6/2015 Keane et al.
9,156,585 B2 10/2015 Neiner
9,162,795 B2 10/2015 Thiemann et al.
9,181,007 B2 11/2015 Forrest et al.
9,186,924 B2 11/2015 Lewis
9,403,628 B2 8/2016 Keane et al.
D770,891 S 11/2016 Porter
2002/0005408 A1 1/2002 Yamasaki et al.
2002/0113069 A1 8/2002 Forrest et al.
2002/0139800 A1 10/2002 Hwang et al.
2003/0038134 A1 2/2003 Chasteen et al.
2003/0075544 A1 4/2003 Turner et al.
2003/0098306 A1 5/2003 Cho
2003/0192889 A1 10/2003 Chasteen et al.
2004/0056032 A1 3/2004 Vaughan
2004/0140309 A1 7/2004 Thibaut
2004/0144787 A1 7/2004 Heck
2004/0188440 A1 9/2004 Schlattl et al.
2004/0211786 A1 10/2004 Turner et al.
2005/0077316 A1 4/2005 Roberts
2005/0115976 A1 6/2005 Watson et al.
2005/0224497 A1 10/2005 Wook
2006/0049196 A1 3/2006 Price
2006/0196875 A1 9/2006 Cherian
2007/0039961 A1 2/2007 McEldowney et al.
2007/0045318 A1 3/2007 Gibson et al.
2007/0068943 A1 3/2007 Ramsey et al.
2007/0108208 A1 5/2007 Dickie
2007/0138178 A1 6/2007 Erickson
2007/0175896 A1 8/2007 Bursztein
2007/0215621 A1 9/2007 Shinguryo et al.
2007/0257035 A1 11/2007 Berndt et al.
2008/0011786 A1 1/2008 Mathabel et al.
2008/0110888 A1 5/2008 Turner et al.
2008/0302793 A1 12/2008 Tirosh et al.
2009/0001081 A1 1/2009 Schlattl et al.
2009/0039090 A1 2/2009 Forrest et al.
2009/0039091 A1 2/2009 Forrest et al.
2009/0057315 A1 3/2009 Stringfield et al.
2009/0173740 A1 7/2009 Ferguson
2009/0194536 A1 8/2009 Ulstein et al.
2009/0200305 A1 8/2009 Stude
2009/0206083 A1 8/2009 Heigl
2009/0266824 A1 10/2009 Turner et al.
2009/0269169 A1 10/2009 Turner et al.
2010/0000997 A1 1/2010 Southers
2010/0018976 A1 1/2010 Christian et al.
2010/0044383 A1 2/2010 Watson et al.
2010/0224511 A1 9/2010 Boatner
2010/0251731 A1 10/2010 Bergida
2010/0258562 A1 10/2010 Linden et al.
2010/0282706 A1 11/2010 Gilliam
2010/0294771 A1 11/2010 Holder et al.
2010/0326281 A1 12/2010 Nishibe et al.
2011/0056946 A1 3/2011 Emanuele, III et al.
2011/0108552 A1 5/2011 Rios
2011/0168714 A1 7/2011 Renz
2011/0226636 A1 9/2011 Petti
2011/0240645 A1 10/2011 Schley et al.
2011/0253719 A1 10/2011 Cherian
2011/0266281 A1 11/2011 Thiemann et al.
2011/0297679 A1 12/2011 Gogola et al.
2011/0303672 A1 12/2011 Fields et al.
2012/0012584 A1 1/2012 Chameroy et al.
2012/0048870 A1 3/2012 Ellerbe, III et al.
2012/0175371 A1 7/2012 Consonni
2012/0199586 A1 8/2012 Shamalta
2012/0199587 A1 8/2012 Norris
2012/0205378 A1 8/2012 Forrest
2012/0228296 A1 9/2012 Fields
2012/0260613 A1 10/2012 Holder et al.
2012/0312815 A1 12/2012 Ramsey et al.
2013/0037542 A1 2/2013 Crothers
2013/0037543 A1 2/2013 McClung et al.
2013/0075401 A1 3/2013 Forrest
2013/0118133 A1 5/2013 Jacober et al.
2013/0126529 A1 5/2013 Nesling et al.
2013/0264343 A1 10/2013 Neiner
2013/0264344 A1 10/2013 Neiner et al.
2013/0270267 A1 10/2013 Ramsey et al.
2013/0270269 A1 10/2013 Lewis
2013/0292382 A1 11/2013 Bork
2013/0299496 A1 11/2013 Forrest et al.
2014/0054290 A1 2/2014 McClung et al.
2014/0054332 A1 2/2014 Mcclung et al.
2014/0069924 A1 3/2014 Malaviya
2014/0096491 A1 4/2014 Chasteen et al.
2014/0103044 A1 4/2014 Ramsey et al.
2014/0110408 A1 4/2014 Mitchell et al.
2014/0158685 A1 6/2014 Thiemann et al.
2014/0263327 A1 9/2014 Chasteen et al.
2014/0263329 A1 9/2014 Chasteen et al.
2014/0263333 A1 9/2014 Keane et al.
2014/0263334 A1 9/2014 Scott
2014/0325943 A1 11/2014 Fesler
2014/0367382 A1 12/2014 Neiner et al.
2014/0374419 A1 12/2014 Neiner
2015/0001220 A1 1/2015 Neiner
2015/0034648 A1 2/2015 Wilson
2015/0053681 A1 2/2015 McClung et al.
2015/0136776 A1 5/2015 Chasteen et al.
2015/0158627 A1 6/2015 Ramsey et al.
2015/0196948 A1 7/2015 McClung et al.
2015/0239607 A1 8/2015 Fields et al.
2015/0251803 A1 9/2015 Rayburn
2015/0367984 A1 12/2015 Forrest et al.
2016/0023801 A1 1/2016 Keane
2016/0039563 A1 2/2016 Dunwoody
2016/0052667 A1 2/2016 Gatewood et al.
2016/0215377 A1 7/2016 Stone et al.
2016/0236825 A1 8/2016 Mijatovic

(56) References Cited

U.S. PATENT DOCUMENTS

FOREIGN PATENT DOCUMENTS

| | | |
|---|---|---|
| CA | 2657391 | 1/2008 |
| CN | 1125679 | 7/1996 |
| CN | 201343207 | 11/2009 |
| CN | 102625769 | 8/2012 |
| EP | 0542517 | 5/1993 |
| EP | 2038178 | 10/2010 |
| ES | 2458098 | 4/2014 |
| ES | 2525589 | 12/2014 |
| GB | 1436617 | 5/1976 |
| GB | 1532081 | 11/1978 |
| GB | 2280165 | 1/1995 |
| GB | 2291030 | 1/1996 |
| GB | 2320008 | 6/1998 |
| JP | H04-311452 | 11/1992 |
| JP | H05-178345 | 7/1993 |
| JP | H06-219448 | 8/1994 |
| JP | 3009188 U | 3/1995 |
| JP | H07-132936 | 5/1995 |
| JP | H07-132937 | 5/1995 |
| JP | H08-151043 | 6/1996 |
| JP | H09-58681 | 3/1997 |
| JP | H09-301364 | 11/1997 |
| JP | H10-035662 | 2/1998 |
| JP | H10-245032 | 9/1998 |
| JP | 2001-18960 | 1/2001 |
| JP | 2003-285837 | 10/2003 |
| JP | 3578797 | 10/2004 |
| JP | 2004-359339 | 12/2004 |
| JP | 2005-088961 | 4/2005 |
| JP | 2006-069605 | 3/2006 |
| JP | 2007-22541 | 2/2007 |
| JP | 2007-529374 | 10/2007 |
| JP | 2009-543737 | 12/2009 |
| JP | 2010-215291 | 9/2010 |
| JP | 4879759 | 2/2012 |
| JP | 2013-531590 | 8/2013 |
| KR | 20050059718 | 6/2005 |
| NL | 1023297 | 11/2004 |
| WO | WO 94/13544 | 6/1994 |
| WO | WO 96/02432 | 2/1996 |
| WO | WO 97/22531 | 6/1997 |
| WO | WO 97/42088 | 11/1997 |
| WO | WO 00/56613 | 9/2000 |
| WO | WO 01/46025 | 6/2001 |
| WO | WO 2008/008892 | 1/2008 |
| WO | WO 2008/023983 | 2/2008 |
| WO | WO 2008/057207 | 5/2008 |
| WO | WO 2010/046516 | 4/2010 |
| WO | WO 2011/053776 | 5/2011 |
| WO | WO 2012/018549 | 2/2012 |
| WO | WO 2012/143322 | 10/2012 |
| WO | WO 2013/022592 | 2/2013 |
| WO | WO 2013/102594 | 7/2013 |
| WO | WO 2013/102595 | 7/2013 |
| WO | WO 2013/156624 | 10/2013 |
| WO | WO 2014/031926 | 2/2014 |
| WO | WO 2014/150180 | 9/2014 |
| WO | WO 2014/152235 | 9/2014 |
| WO | WO 2015/138413 | 9/2015 |

OTHER PUBLICATIONS

Murray "Vented can ends give Coors a smoother pour," thedrinksreport, Jul. 12, 2013, 3 pages [retrieved from: http://www.thedrinksreport.com/news/2013/14996-vented-can-ends-give-coors-a-smoother-pour.html].

International Preliminary Report on Patentability for International (PCT) Patent Application No. PCT/US2014/020821, dated Sep. 24, 2015 8 pages.

Notice of Allowance for U.S. Appl. No. 29/502,091, dated Oct. 1, 2015 6 pages.

Notice of Allowance for U.S. Appl. No. 29/502,090, dated Oct. 14, 2015 7 pages.

International Search Report and Written Opinion for International (PCT) Patent Application No. PCT/US16/41243, dated Sep. 27, 2016 10 pages.

Official Action (with English translation) for Chinese Patent Application No. 201280066183.6, dated May 17, 2016 11 pages.

Official Action for U.S. Appl. No. 14/877,743, dated Oct. 11, 2016 19 pages.

Official Action for U.S. Appl. No. 14/198,174, dated Sep. 29, 2016 17 pages.

"CDL End," Ball, 2016, 2 pages [retrieved from: http://www.ball.com/eu/solutions/markets-capabilities/capabilities/beverage-ends/cdl].

Official Action with English Translation for China Patent Application No. 201280066183.6, dated Jan. 3, 2017 19 pages.

Notice of Allowance with English Translation for China Patent Application No. 201480015945.9, dated Sep. 20, 2016 5 pages.

International Preliminary Report on Patentability for International (PCT) Patent Application No. PCT/US2015/042579, dated Jan. 31, 2017 9 pages.

Official Action for U.S. Appl. No. 29/545,384, dated Feb. 15, 2017 7 pages.

Official Action for U.S. Appl. No. 14/812,549, dated Dec. 2, 2016 7 pages.

U.S. Appl. No. 29/545,384, filed Nov. 12, 2015, Jacober et al.

U.S. Appl. No. 15/581,932, filed Apr. 28, 2017, Scott.

U.S. Appl. No. 15/657,374, filed Jul. 24, 2017, Chasteen et al.

Official Action for Australia Patent Application No. 2016201855, dated Apr. 13, 2017, 3 pages.

Notice of Allowance for Canadian Patent Application No. 2,854,320, dated Apr. 4, 2017, 1 page.

Official Action for U.S. Appl. No. 14/877,743, dated Apr. 20, 2017 24 pages.

Official Action for U.S. Appl. No. 29/545,384, dated Apr. 17, 2017 5 pages.

Notice of Allowance for U.S. Appl. No. 14/198,174, dated Mar. 6, 2017 17 pages.

U.S. Appl. No. 29/502,091, filed Sep. 11, 2014, Scott.

U.S. Appl. No. 29/502,090, filed Sep. 11, 2014, Jacober et al.

U.S. Appl. No. 29/519,457, filed Mar. 5, 2015, Jacober et al.

U.S. Appl. No. 29/519,461, filed Mar. 5, 2015, Jacober et al.

U.S. Appl. No. 14/812,549, filed Jul. 29, 2015, Chasteen et al.

News Releases: "The Can, ReinVented: Louisville is Pilot Market for New Bud Light Vented Can" Anheuser-Busch InBev, Jun. 5, 2013, 3 pages.

Press Release: "Crown and Molson Coors Debut Cans with New Vented End in Canada," Crown Holdings, Inc., Jul. 11, 2013, 2 pages.

"How Ball Makes Beverage Ends," Ball, last modified Dec. 5, 2013, 1 page [retrieved from: http://www.ball.com/images/ball_com/product_options_files/How_Ball_Makes_Beverage_Ends.pdf].

International Search Report for International (PCT) Application No. PCT/US11/44940, dated Dec. 22, 2011, 3 pages.

Written Opinion for International (PCT) Application No. PCT/US11/44940, dated Dec. 22, 2011, 5 pages.

International Preliminary Report on Patentability for International (PCT) Application No. PCT/US11/44940, dated Feb. 21, 2013, 7 pages.

Official Action for Australia Patent Application No. 2011286291, dated Dec. 12, 2013 3 pages.

Notice of Allowance for Australia Patent Application No. 2011286291, dated Apr. 3, 2014 2 pages.

Official Action for Canadian Patent Application No. 2,806,879 dated Oct. 23, 2013, 2 pages.

Official Action (with English translation) for Chinese Patent Application No. 201180046744.1, dated Jul. 1, 2014, 16 pages.

Official Action (with English translation) for Chinese Patent Application No. 201180046744.1, dated Feb. 6, 2015, 7 pages.

Notice of Allowance with English Translation for China Patent Application No. 201180046744.1, dated May 11, 2015 4 pages.

Extended European Search Report for European Patent Application No. 11815019.2 dated Mar. 27, 2014, 7 pages.

(56) References Cited

OTHER PUBLICATIONS

Official Action with English Translation for Russia Patent Application No. 2013109931/12, dated Jul. 21, 2015 7 pages.
International Search Report and Written Opinion for International (PCT) Application No. PCT/US12/63384 dated Feb. 1, 2013, 8 pages.
International Preliminary Report on Patentability for International (PCT) Patent Application No. PCT/US2012/063384, dated May 14, 2015 7 pages.
Official Action for Australia Patent Application No. 2012332214, dated Jun. 10, 2015 3 pages.
Official Action for Canada Patent Application No. 144505, dated Jun. 13, 2012 2 pages.
English translation of Notice of Allowance for China Patent Application No. 201230127943.2, dated Aug. 20, 2012 2 pages.
Official Action for Canadian Patent Application No. 150953 dated Feb. 26, 2014, 2 pages.
Notice of Allowance with English Translation for China Patent Application No. 201330161204.X, dated Oct. 16, 2013 4 pages.
Official Action for Canadian Patent Application No. 151227 dated Feb. 26, 2014, 2 pages.
Notice of Allowance with English Translation for China Patent Application No. 201330204259.4, dated Sep. 26, 2013 4 pages.
Notice of Allowance (no English translation available) for Russian Patent Application No. 2013501911 dated Feb. 27, 2014, 2 pages.
International Search Report and Written Opinion for International (PCT) Application No. PCT/US14/20821 dated Jun. 24, 2014, 9 pages.
Official Action for U.S. Appl. No. 12/851,979, dated Sep. 28, 2012 10 pages.
Final Action for U.S. Appl. No. 12/851,979, dated Apr. 29, 2013, 11 pages.
Notice of Allowance for U.S. Appl. No. 12/851,979, dated Jul. 11, 2013, 8 pages.
Official Action for U.S. Appl. No. 13/667,928, dated Jul. 8, 2015 21 pages.
Notice of Allowance for U.S. Appl. No. 13/667,928, dated Aug. 26, 2015 9 pages.
Official Action for U.S. Appl. No. 29/404,996 dated Apr. 12, 2013, 5 pages.
Notice of Allowance for U.S. Appl. No. 29/404,996 dated May 30, 2013, 7 pages.
Official Action for U.S. Appl. No. 29/464,785 dated Jun. 24, 2014, 7 pages.
Official Action for U.S. Appl. No. 29/437,073 dated Apr. 9, 2014, 6 pages.
Notice of Allowance for U.S. Appl. No. 29/437,073 dated Jun. 26, 2014, 10 pages.
Official Action for U.S. Appl. No. 29/502,091, dated Jul. 31, 2015 6 pages.
Official Action for U.S. Appl. No. 29/438,299 dated Apr. 9, 2014, 7 pages.
Notice of Allowance for U.S. Appl. No. 29/438,299 dated Jun. 26, 2014, 8 pages.
Official Action for U.S. Appl. No. 29/502,090, dated Jul. 31, 2015 7 pages.
"Aluminum Bottles are Here to Stay," The Packaging Insider, Dec. 28, 2011, 4 pages [retrieved from: http://thepackaginginsider.com/aluminum-bottles-coca-cola/].
"A Smoother Pour with Crown's Global Vent™," 2015, retrieved from www.crowncork.com/beverage-packaging/innovations-beverage-cans/global-vent, 2 pages.
Intention to Grant for European Patent Application No. 11815019.2 dated May 10, 2016 36 pages.
Official Action for U.S. Patent Application No. 11815019.2, dated Nov. 18, 2015 5 pages.
Official Action with English Translation for Vietnam Patent Application No. 1-2013-00709, dated Nov. 27, 2015 1 page.
Notice of Acceptance for Australia Patent Application No. 2012332214, dated Dec. 10, 2015 3 pages.
Official Action for Canadian Patent Application No. 2,854,320, dated Dec. 9, 2015, 5 pages.
Official Action and Search Report (with English translation) for Chinese Patent Application No. 201280066183.6, dated Sep. 22, 2015 18 pages.
Extended European Search Report for European Patent Application No. 12846663.8, dated May 31, 2016, 7 pages.
Official Action (English translation) for Russian Patent Application No. 2014122525, dated Nov. 25, 2015, 3 pages.
Official Action with English Translation for China Patent Application No. 201480015945.9, dated Apr. 20, 2016 11 pages.
International Search Report and Written Opinion for International (PCT) Patent Application No. PCT/US15/42579, dated Oct. 28, 2015, 23 pages.
Notice of Allowance for U.S. Appl. No. 14/066,457, dated May 23, 2016 8 pages.
Supplemental Notice of Allowance for U.S. Appl. No. 14/066,457, dated May 31, 2016 8 pages.
Official Action for U.S. Appl. No. 29/519,457, dated Dec. 9, 2015, 7 pages.
Notice of Allowance for U.S. Appl. No. 29/519,457, dated Mar. 16, 2016, 7 pages.
Official Action for U.S. Appl. No. 29/519,461, dated Dec. 21, 2015, 7 pages.
Official Action for U.S. Appl. No. 29/519,461, dated Apr. 13, 2016, 4 pages.
Official Action for U.S. Appl. No. 14/198,174, dated Mar. 31, 2016 15 pages.

CONTAINER END CLOSURE WITH OPTIONAL SECONDARY VENT OPENING

CROSS-REFERENCE TO RELATED APPLICATIONS

This U.S. Non-Provisional patent application is a Continuation-in-Part of and claims priority to U.S. patent application Ser. No. 14/066,457, filed Oct. 29, 2013, which is a Continuation of U.S. patent application Ser. No. 12/851,979, filed Aug. 6, 2010, now U.S. Pat. No. 8,567,158, and this U.S. Non-Provisional patent application claims priority to U.S. Provisional Patent Application No. 62/039,020 filed Aug. 19, 2014, the entire disclosures of which are hereby incorporated by reference in their entirety.

FIELD OF THE INVENTION

The present invention relates to an end closure for a beverage container. More specifically, the present invention relates to an end closure for a container which comprises a first opening portion and at least one secondary opening portion to enhance venting and improve outflow of the product during pouring.

BACKGROUND OF THE INVENTION

Containers and more specifically metallic beverage containers are typically manufactured by interconnecting a beverage container end closure to the neck of a beverage container body. In some applications, an end closure may be interconnected on both a top side and a bottom side of a container body. More frequently, however, a beverage container end closure is interconnected on a top end of a beverage container body which has been drawn and ironed from a flat sheet of blank material such as aluminum. It is generally known to provide end closures for beverage containers, and which utilize an opening device for selectively opening a portion of the end closure. For example, pull tabs or stay on tabs ("SOT") generally include a nose and a tail portion and a rivet which interconnects the pull tab to the upper surface of the end closure. The tail portion generally has a loop or tail that may be pulled upwardly by a user which drives the nose portion of the pull tab downward to initiate the opening of the container by shearing a score line which defines the primary opening to the end closure.

Conventional beverage container end closures with SOT's generally suffer from low, inconsistent, and/or uneven flow rates as the contents in the container are poured due to the fact that these end closures provide a single opening area of predetermined size. Conventional container end closures are generally designed for pouring the container contents, with little or no consideration given to inward air flow needed for the volume exchange that facilitates smooth and consistent pouring.

Various patents have attempted to improve end closure pourability by creating one or more openings. These patents include U.S. Pat. No. 7,513,383 to Hwang and U.S. Pat. No. 4,289,251 to Maliszewski, which are incorporated herein by reference in their entireties. Hwang discloses an opening device for a can, with distinct first and second opening portions so that the fluid may flow more consistently from the can. Hwang, however, fails to teach various novel features of the present invention, including a secondary opening portion which may be selectively opened in order to complement or facilitate flow rate through a primary opening portion, and by rotating the pull tab to a preferred orientation. Maliszewski discloses a container end closure with a first score line defining a first displaceable panel portion and second score line defining a second displaceable panel portion. Maliszewski, however, fails to teach various novel features of the present invention, including a secondary opening portion which may be selectively opened in order to complement or facilitate flow rates through a primary opening portion.

The following disclosure describes an improved container end closure which is adapted for interconnection to a container body and which has a first opening portion, a rotatable tab, and at least one additional vent opening for selectively facilitating the flow rate of contents from within the container.

SUMMARY OF THE INVENTION

Based on the limitations of end closures discussed above, there is an unmet need for an end closure with a pull tab, a primary opening area, and at least one optional additional opening area to facilitate the pouring of contents from a container. There has further been a long-felt and unmet need to provide such a device wherein an additional opening area is selectively activated or opened based on a user's preference, and utilizing the same mechanics of the existing pull tab mounted on the end closure. The following disclosure generally describes a metal end closure with a pull tab and a plurality of opening areas that employs a novel combination of features that address these long felt needs.

In one aspect of the present invention, a container end closure is provided with a primary opening portion and at least one additional opening portion which may be selectively opened by a user to create improved flow characteristics due to a larger opened area and/or an area which allows for air intake into a container body through one or more vent openings while contents flow out through another opening.

In various embodiments, container end closures of the present invention are adapted for connection with a neck of a container body. More specifically, the end closure generally comprises a peripheral curl for double seaming to a neck of a container, a chuck wall extending downwardly from the peripheral curl, a countersink comprised of an outer panel wall and an inner panel wall, and a central panel extending inwardly from the inner panel wall of the countersink. For the purposes of further supporting and enabling the present disclosure, U.S. Pat. No. 7,506,779 to Jentzsch et al. entitled "Method and Apparatus for Forming a Reinforcing Bead in a Container End Closure" and U.S. Pat. No. 7,100,789 to Nguyen et al. entitled "Metallic Beverage Can End With Improved Chuck Wall and Countersink" are incorporated by reference herein in their entireties.

It is another aspect of the present invention to provide an end closure with a primary opening where a tab is interconnected to a central panel unit, a rivet for rotatably securing the tab on the end closure, a secondary score line which defines a secondary opening area, and a transition zone between the primary and secondary openings. The transition zone can be a scoreless portion of the central panel or the transition zone can be a score, for example, a check slot. In one embodiment, first and second opening areas are positioned adjacent to one another and the transition zone prevents opening of a secondary opening area when the tab is utilized to open the first opening area. For example, in one embodiment, the transition zone inhibits the propagation of a primary score line into a secondary score line or opening area. Alternatively, the first and second opening areas are not positioned adjacent to each other, but rather are spaced in distinct locations.

It is another aspect of the present invention to provide a rotatable tab which is capable of opening a gate defined within a first opening area through a first opening movement or lifting of the tab, and which is subsequently capable of being rotated and utilized to open a secondary opening area through a second opening movement. Thus, a user can selectively determine whether they want to utilize the secondary opening for venting, or drink from the container in a conventional manner from the primary opening without the increased flow resulting from venting.

It is another aspect of the present invention to provide a tab with one or more features which limit or otherwise define the amount of desirable or necessary rotation needed in order to reposition the tab for opening one or more secondary opening areas of a control panel. For example, features of the present invention may include recessions or cut outs within a tab and corresponding protrusions or detents on the central panel which restrict the tab from rotating about a rivet beyond a predetermined orientation. In an alternative embodiment, a portion of a central panel of the present invention is adapted to receive a tab and thus limit the amount of rotation of a tab from an initial position. In one embodiment, a tab is rotatable on an end closure central panel between an angle of zero degrees (i.e. with respect to an initial position) and +/−90 degrees. In an alternative embodiment, a tab is rotatable about an axis substantially parallel to a horizontal plane of a central panel between an angle of zero degrees (i.e. with respect to an initial position) and +/−45 degrees.

In another embodiment, an end closure is provided that has at least first and secondary opening portions, wherein the first and secondary opening portions may be opened with very minimal rotation of the tab. Alternatively, there may be no rotation of the tab, or only a slight twisting of the tab after the first opening is formed. For example, in one embodiment, the present invention comprises a first opening area defined by a score line and a gate contained therein, the score line adapted to be severed and the gate opened by the tilting of the tab. The second opening area is defined by a secondary score line and a transition zone, the transition zone inhibiting the propagation of a the primary score line and requiring a user to exert an additional or distinct force (i.e. as compared to the force applied to open the primary opening portion) in order to open the secondary opening portion. Thus, in one embodiment, a first and second opening portion may be opened in series through the application of one or more forces, wherein the opening of the second opening portion is distinct from the first due to, for example, a transition zone. Thus, in one embodiment, a tab need not be rotated about a longitudinal axis of a container body and end closure combination in order to sever or open a secondary opening area. Alternatively in other embodiments, the tab may be slightly twisted or rotated in the clockwise direction to assist in the propagation of a fracture along the secondary score.

In one embodiment, an end closure adapted for connection to a container body is provided. The metal end closure comprises a substantially planar central panel, and force applying means for applying inwardly directed forces on the central panel. Force applying means may include, by way of example only, a tab having a loop or tail portion and nose portion, wherein the tab is connected to an end closure with a rivet.

In alternative embodiments, an end closure does not comprise a tab as found on various SOTs. Rather, in certain embodiments, an end closure is provided with a primary opening area/portion and at least one secondary selectively opening area/portion wherein said first and secondary opening areas are scored or severed away from a panel with an additional tool. Additional tools comprise, but are not limited to, known can openers and similar devices adapted for opening or tearing a central panel. In one embodiment, force applying means comprise a tool or object which is not joined or attached to the end closure. For example, various known bottle openers, "church keys," and similar devices adapted for applying a force to an end closure may be provided.

In one embodiment, pivot means are permanently mounted on said central panel for pivotally mounting the force applying means on the central panel. Pivot means may include, for example, a rivet attached to a portion of a central panel and a rivet island or similar rivet receiving portion disposed on a tab. Thus, in various embodiments, pivot means are provided which allow for a tab to rotate about an axis generally parallel with a longitudinal axis of an end closure/container combination, yet generally prevent the inadvertent displacement of a tab from a central panel. Rotational limiting means may be provided on the end closure and adapted for limiting the amount of rotation of the force applying means. Rotational limiting means of the present invention include, but are not limited to, detents, protrusions, recessions, and various other features formed or placed on a central panel and adapted for contacting a tab and/or supplying visual indication of a desirable orientation of a tab.

A first opening portion having a severable score line is provided in one embodiment, the severable score line defining the first opening portion and a first hinge portion integral with the central panel. In one embodiment, a second opening portion is provided which comprises a severable score line defining the second opening portion and a second hinge portion integral with the central panel, and a transition portion which substantially prevents a fracture propagation of said severable score line of said first opening portion into said severable score line of said second opening portion.

It is another aspect of the present invention to provide a method of opening a container, i.e., enhancing the pourability of a container. This includes, but is not limited to a method comprising the steps opening a primary opening area wherein force applying means are tilted to apply a first downward force on a first opening portion to sever a first severable score line. Subsequently, the force applying means (e.g. pull tab) is at least partially restored to a first initial position and the force applying means is rotated such that a nose portion of the force applying means is positioned over a portion of a second opening portion and the force applying means is tilted to apply a second downward force on a second opening portion to sever a second score line. Alternatively, a third opening could be formed in alternative embodiments by further rotation of the pull tab and severing a third opening. In embodiments, similar steps may be repeated so as to open one or more additional venting portions disposed on an end closure.

One particular embodiment of the invention is a container end closure with a peripheral curl adapted for interconnection to a neck of a container, comprising a central panel; a pull tab comprising a nose and a tail, the pull tab adapted for applying a downward force on a predetermined portion of the central panel; a rivet operatively interconnecting the pull tab to an upper surface of the central panel and allowing the pull tab to rotate; a first opening portion at least partially defined by a first severable score line; a second vent opening portion at least partially defined by a second severable score line, and wherein the second severable score line and the first severable score line are substantially oriented along a common line; and a transition portion positioned between the first severable score line and the second severable score line which is adapted to inhibit propagation of a fracture from the first severable score line into the second severable score line, and wherein the nose of the pull tab can selectively move between a first position over the first opening portion and a second position over the second vent opening portion to facilitate opening of the first and second portions as the nose portion of the pull tab is pushed downward.

Another embodiment of the invention is a method of opening an end closure of a container with a first opening portion and a second vent opening portion, comprising (a) positioning a pull tab, which is interconnected to a central panel of the end closure with a rivet, to a first opening position; (b) lifting a tail end of the pull tab to apply a first downward force on the first opening portion of the central panel to shear a first score line up to a transition portion and create a first opening in the central panel, wherein the first score line and the transition portion have distinct score residuals; (c) repositioning the pull tab to a second opening position; and (d) lifting the tail end of the pull tab to apply a second downward force on the second vent opening portion to shear the transition portion positioned between the first score line and a second score line and to shear the second score line to form a second vent opening in the central panel, wherein the second severable score line is oriented in the same line as the first severable score, wherein the transition portion and the second score line have distinct score residuals, and wherein the first opening portion and the second vent opening portion are integrally interconnected to form an opening larger than either the first opening or the second vent opening.

Yet another embodiment of the invention is a container end closure with a peripheral curl adapted for interconnection to a neck of a container, comprising a central panel; a pull tab comprising a nose and a tail, the pull tab adapted for applying a downward force on the central panel; a rivet operatively interconnecting the pull tab to an upper surface of the central panel and allowing the pull tab to be repositioned between a primary position to open a primary opening portion and a second position to open a second vent opening portion; the primary opening portion at least partially defined by a primary severable score line; the second vent opening portion at least partially defined by a second severable score line; and a check slot positioned between the primary severable score line and the second severable score line which is adapted to inhibit propagation of a fracture from the primary severable score line into the second severable score line, the check slot is a score line having a score residual that is distinct from a score residual of the primary severable score line and a score residual of the second severable score line.

These and other advantages will be apparent from the disclosure of the invention(s) contained herein. The above-described embodiments, objectives, and configurations are neither complete nor exhaustive. As will be appreciated, other embodiments of the invention are possible using, alone or in combination, one or more of the features set forth above or described in detail below. Further, the summary of the invention is neither intended nor should it be construed as being representative of the full extent and scope of the present invention. The present invention is set forth in various levels of detail in the summary of the invention, as well as in the attached drawings and the detailed description of the invention and no limitation as to the scope of the present invention is intended to either the inclusion or non-inclusion of elements, components, etc. in this summary of the invention. Additional aspects of the present invention will become more readily apparent from the detailed description, particularly when taken together with the drawings.

BRIEF DESCRIPTION OF THE DRAWINGS

The accompanying drawings, which are incorporated in and constitute part of the specification, illustrate various embodiments of the present invention and together with the general description of the invention given above serve to explain the principle of these inventions.

Figure 1:
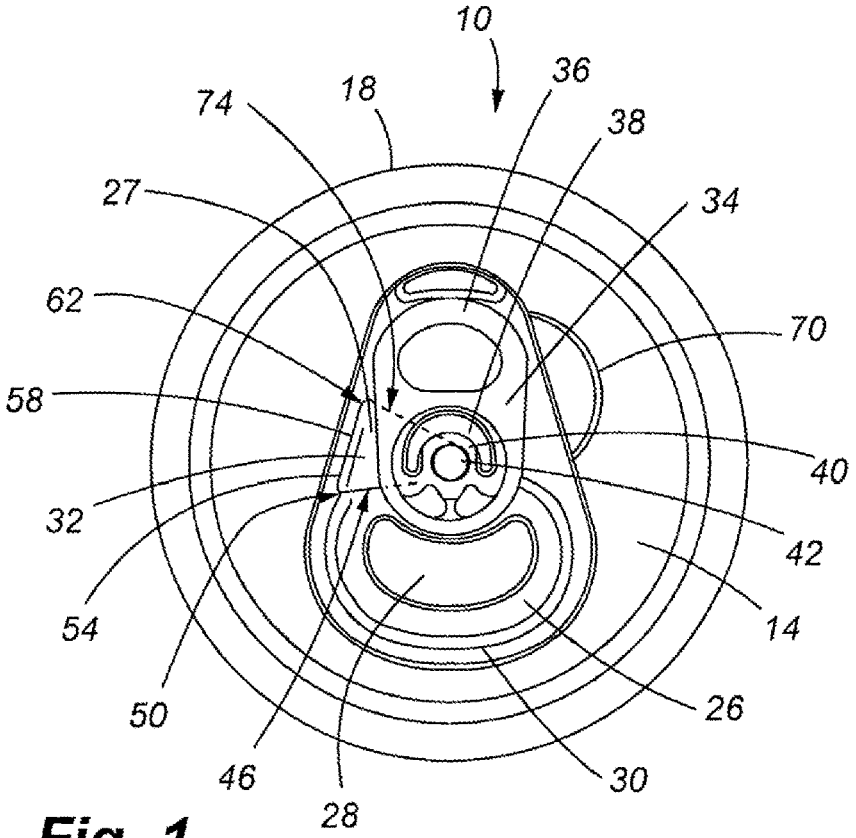
FIG. 1 is a top plan view of a metal end closure according to one embodiment wherein a tab and a first opening portion are in a first closed position.

To further assist in the understanding of the invention, the following is a table of components found in the drawings and associated numbering.

| | |
|---|---|
| 10 | End Closure and Container Body |
| 14 | Panel |
| 18 | Peripheral Curl |
| 26 | Gate |
| 27 | Secondary Gate |
| 28 | Primary Opening Area |
| 30 | Primary Score |
| 32 | Secondary Vent Opening Area |
| 33 | Third Opening Area |
| 34 | Tab |
| 35 | Nose Portion |
| 36 | Tail |
| 38 | Rotational Guide |
| 40 | Rivet Island |
| 42 | Rivet |
| 46 | Primary Score Opening Hinge |
| 50 | Primary Score Termination Feature |
| 54 | Transition Zone |
| 55 | Void |
| 58 | Secondary Score |
| 62 | Secondary Score Termination Feature |
| 66 | Tab Positioning Stop |
| 70 | Tab Rotation Guide |
| 74 | Secondary Score Hinge |
| 78 | Stiffening Bead |
| 80 | Third Gate |
| 82 | Rotation Limit |
| 84 | Rivet Island Rotation Guide |
| 86 | Anti-Fracture Score |
| 88 | Score Tool |
| 90 | Horizontal Insert Line |
| 92 | Horizontal Rivet Line |
| 94 | Vertical Insert Line |

-continued

| | |
|---|---|
| 96 | Horizontal Score Line |
| 98 | First Datum Point |
| 100 | Second Datum Point |
| 102 | Third Datum Point |
| 104 | Fourth Datum Point |
| 106 | Fifth Datum Point |
| 108 | Sixth Datum Point |
| 110 | Transition Check Slot |
| 112 | Transition Check Slot Angle |
| 114 | Anti-Fracture Score Angle |
| 116 | Seventh Datum Point |
| 118 | Termination Feature Angle |
| 120 | Transition Check Slot Width |
| 122 | Transition Check Slot Depth |
| 124 | Score Pitch |
| 126 | Primary Score Width |
| 128 | Anti-Fracture Score Width |
| 130 | Primary Score Depth |
| 132 | Score Offset |
| 134 | Score Radius |
| 136 | Score Side Angle |
| 138 | Overall Score Angle |
| 140 | Secondary Score Radius |
| 142 | Check Slot Angle |
| 144 | Check Slot Midpoint |
| 146 | Check Slot Length |
| 148 | Check Slot Relative Depth |
| 150 | Tenth Datum Point |
| 152 | Eleventh Datum Point |
| 154 | Twelfth Datum Point |
| 156 | Thirteenth Datum Point |
| 158 | First Angle |
| 160 | Second Angle |
| 162 | Anti-Fracture Score Depth |
| 164 | Notch |
| 166 | Index Feature Width |
| 168 | Index Feature Offset |
| 170 | Tool Flange Width |
| 172 | Tool Flange Height |
| 174 | Tool Lip Width |
| 176 | Tool Lip Height |
| 178 | Tool Gap Width |
| 180 | Tool Gap Height |
| 182 | Tool Gap Radius |
| 184 | Tool Height |
| 186 | Tool Width |
| 188 | Main Score Height |
| 190 | Rivet Diameter |
| 192 | Rivet Offset |
| 194 | Rivet Chamfer |

It should be understood that the drawings are not necessarily to scale. In certain instances, details that are not necessary for an understanding of the invention or that render other details difficult to perceive may have been omitted from these drawings. It should further be understood that the invention is not limited to the particular embodiments illustrated in the drawings.

DETAILED DESCRIPTION

Various embodiments of the present invention are described herein and as depicted in the drawings. It is expressly understood that although FIGS. 1-8 depict a metal end closure with a pull tab and at least one secondary vent opening, the present invention is not limited to these embodiments.

Referring now to FIG. 1, a top plan view of a metal end closure according to one embodiment is shown, and wherein a first opening portion is in a first closed position. An end closure adapted for interconnecting to a container body is shown wherein the end closure comprises a panel 14 with a primary opening area 28 and a secondary opening area 32. In one embodiment, a primary opening area 28 comprises a first gate 26 which is defined by a primary score line 30 when the primary opening area 28 is in a first closed position. A primary opening area 28 of the present invention may comprise, for example, portions of material capable of being at least partially separated from and retained by a remainder of the central panel. The primary opening area 28 is at least initially separated from a secondary opening area 32 and secondary gate 27 by a primary opening hinge 46. The primary opening hinge 46 facilitates the selective opening of a primary opening area 28 by a nose of a pull tab or other firm force applying means without simultaneously opening a secondary opening area 32. Force applying means of the present invention may include, but are not limited to, a tab 34 comprising a nose portion 35 and a rivet 42 in communication with a rivet island 40 and a tail 36. As the tail 36 is pulled upward, the nose 35 is driven downward to shear the score line 30 and initiate opening.

In one embodiment, a secondary score 58 starts at the end of a first transition zone (54, in FIG. 4B) and allows for fracture propagation to the secondary score termination feature 62, thus creating a vent feature when the appropriate force is applied. In various embodiments, secondary scores 58 of the present invention may be straight or curved at various angles. Secondary score termination features 62 of the present invention are provided to generally define or limit the propagation of a secondary score 58. In one embodiment, a secondary score termination feature 62 comprises a curved profile for facilitating the prevention of propagation of a score line and creating a desirable venting shape.

Furthermore, the present invention contemplates a secondary score hinge 74. The secondary score hinge 74 of the present invention is generally defined as a portion of the panel 14 residing between a terminus of a secondary score line and a point on the panel 14 proximate to the rivet 42. In one embodiment, hinges of the present invention are disposed at a location relative to the tab 34 such that the hinge serves as a point of rotation for a portion of material, such as a secondary gate 27.

In one embodiment, first 46 and second 74 hinges are disposed on a central panel in a region defined between approximately 0 and 240 degrees (i.e. with zero degrees corresponding to a center line of a tab as shown in FIG. 1). One of skill in the art will recognize that a secondary opening portion 32 may be disposed in a variety of locations, either adjacent or non-adjacent to the primary opening area 28 so long as adequate room is provided for a primary opening area 28.

In general, a tab 34 is provided on the end closure 10 which is rotatably secured on the end closure 10 via "pivot means." Pivot means may include, but are not limited to, a rivet 42 secured to the central panel 14 and which engages a portion of the tab 34, such as a rivet island 40. In one embodiment, the pivot means allows the tab 34 to rotate on the central panel 10. In various embodiments, a tab 34 is oriented generally perpendicular with respect to a longitudinal length of the container, with the longitudinal length of the container defining a center of rotation of the tab 34. As one of ordinary skill in the art will recognize, when a portion of a tab 34 of the present invention is lifted and leveraged about a point generally defined by the location of a rivet 42, a downward opening force is applied to a gate 26 of a first opening portion 28 of the present invention. The downward force will shear a gate 26 away from the panel 14 at the primary score 30, propagating around the score 30 until an opening is formed and thus allowing the container contents to pour out.

The present invention further contemplates a secondary opening area 32, generally defined by a secondary score line 58, a primary score opening hinge 46, and a transition zone 54. In one embodiment, the primary score opening hinge 46 of the present invention is created by the initial fracture proximal to the rivet 42 which propagates around the primary score 30 to the primary score termination feature 50. When the fracture reaches the primary score termination feature 50, the tab 34 will be disposed approximately perpendicular to the panel 14, thus resulting in a force applied by the tab 34 upon the gate 26 in a direction that is substantially perpendicular to a longitudinal axis of a container. As one of ordinary skill in the art will recognize, the tab 34 in this position will generally bend the gate 26 as opposed to further tearing, shearing, fracturing, etc. the gate 26. Furthermore, as will be described in more detail, a primary score termination feature 50 is provided which dictates the general area at which the primary score fracture propagation will terminate.

In one embodiment, a transition zone 54 is provided on the central panel 14. Transition zones 54 of the present invention generally comprise an area that inhibits fracture propagation of a primary score 30 into the secondary score 58 and thus helps prevent the unintentional opening of a secondary opening area 32. For example, a transition zone 54 of the present invention may terminate propagation of a primary score 30 fracture due to a score residual depth, interferences in score path (e.g. a check slot), a predetermined void distance between primary 30 and secondary 58 scores, and/or various combinations thereof including, but not limited to, increased material thickness. In one embodiment, a secondary opening area 32 of the present invention is preferably positioned so that the opening area 32 generally spans a lateral midline of the central panel 14 (i.e. a line running laterally through a rivet 42 disposed in the center of a central panel 14 as shown in FIG. 1). One of ordinary skill in the art will appreciate, however, that the location of the secondary opening area 32 may be altered and/or repositioned in a variety of locations.

As will be understood by one of ordinary skill in the art, a secondary opening area 32 may be positioned on either side of a tab 34 of the present invention. In one embodiment, the present invention 10 contemplates a plurality of optional opening areas 32 in addition to a primary opening area 28. For example, in one embodiment, auxiliary opening areas 32 are provided on both sides of a tab 34 of the present invention as will be described in more detail.

In alternative embodiments, a first opening area and a secondary opening area are opened or severed through the use of an additional or external tool, such as a known can openers and "church keys." Thus, in various embodiments, permanent features such as rivets and tabs need not be provided on central panels in accordance with the present invention. Rather, areas of a central panel may be opened through the use of additional tools.

Figure 2:
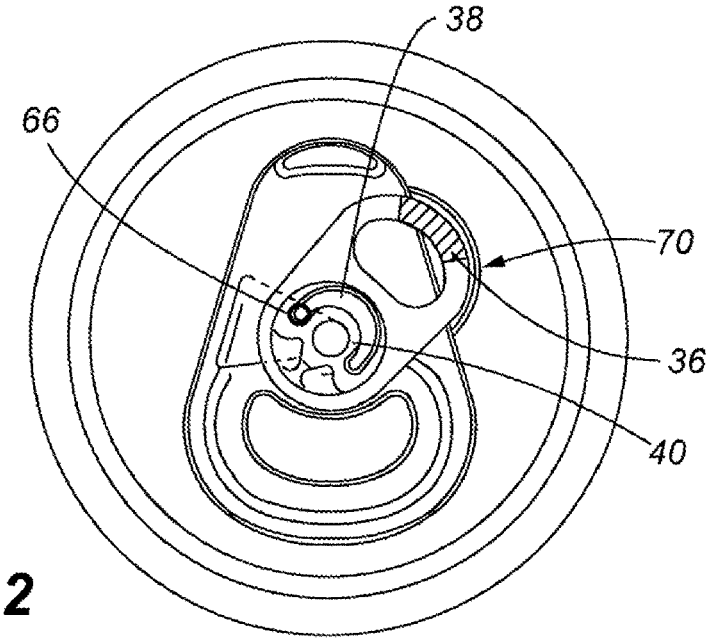
FIG. 2 is a top plan view of a metal end closure according to one embodiment wherein a tab has been rotated to a second position.

Referring now to FIG. 2, a top plan view of a metal end closure according to one embodiment is shown where a tab has been rotated to a second position. As previously discussed, a pull tab 34 may be connected to a panel by a rivet 42 in a manner that allows for rotation of the pull tab. In one embodiment, a tab 34 of the present invention comprises an apparatus which limits the amount of rotation of the pull tab to a predetermined position. Rotation limiting means include, but are not limited to, stationary protrusions and/or depressions disposed on a panel 14 adapted for contacting additional parts of a central panel, such as a tab 34 or rivet island, as well as various other similar features as will be recognized by one of skill in the art. For example, in certain embodiments, a rotational guide 38 is provided which is adapted to help guide, define, and/or limit the path and/or amount of rotation of a tab 34. In other embodiments a tab positioning stop 66 is provided on a central panel so as to limit the amount of rotation achieved by a tab 34. Tab positioning stops 66 of the present invention may be comprised of protrusions stamped from a central panel 14 to form a deboss or may comprise additional features, elements, or material added to a central panel 14. In other embodiments, rotation may be defined and/or limited by features that have been added or joined to a panel 14, in addition to or in lieu of protrusions, indentations, or profiles formed from a panel 14.

It is thus one aspect of the present invention to provide a rotational positioning stop 66 which inhibits the rotation of a tab 34 beyond a predetermined point corresponding to a preferred position of a tab 34 for opening of a secondary opening area 32. For example, in one embodiment, at least one peripheral wall portion of a rotation guide 38 abuts a rotational positioning stop when the tab 34 is rotated to a position where subsequent lifting of the tab 34 will open a secondary opening area 32 with the least amount of force and/or damage to the central panel 14. In some embodiments, the rotation guide 38 may have a horseshoe shape with the left leg of the horseshoe longer than the right leg or the right leg longer than the left leg. In various embodiments, the legs of the horseshoe shape are equal in length.

In another embodiment, a tab rotation guide 70 or debossed profile may be provided on a panel 14 to guide and/or limit the rotation of a tab 34, either in addition to or in lieu of a tab positioning stop 66 and rotation guide 38 arrangement. For example, a debossed profile 70 may be provided to physically prevent the rotation of a tab 34 beyond a given point by contacting a portion of the perimeter edge of the rotation guide 70, and/or provide visual information to a user as to a maximum preferred limit of rotation of a tab 34.

Figure 3A:
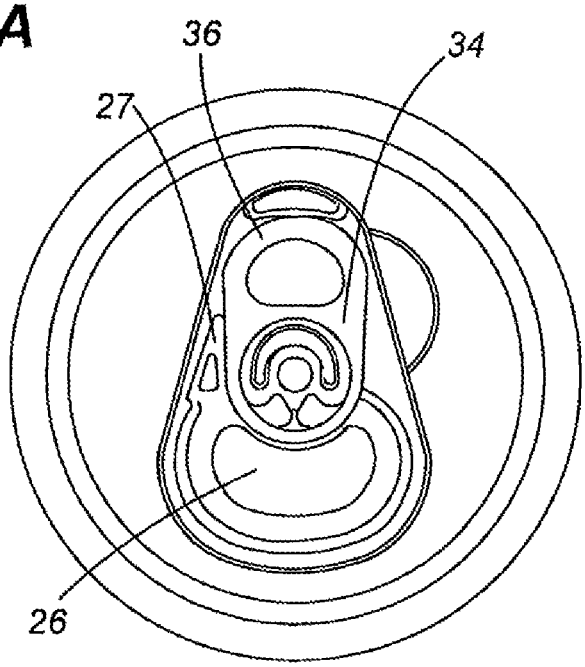
FIG. 3*a* is a top plan view of a metal end closure according to one embodiment wherein a tab and a first opening portion are in a first closed position.

Referring now to FIGS. 3A, 3B, 3C, and 3D, top plan views depicting an opening sequence of one embodiment of the present invention 10 are provided. FIG. 3A is a top plan view of a metal end closure according to one embodiment wherein a tab and a first opening portion are in a first closed position. A panel 14 is depicted, the panel 14 having a first opening area 28 with a gate 26 in a first closed position, a secondary opening area 32 with a secondary gate 27 in a first closed position, and a tab 34 attached to a rivet 42 in an initial position.

Figure 3B:
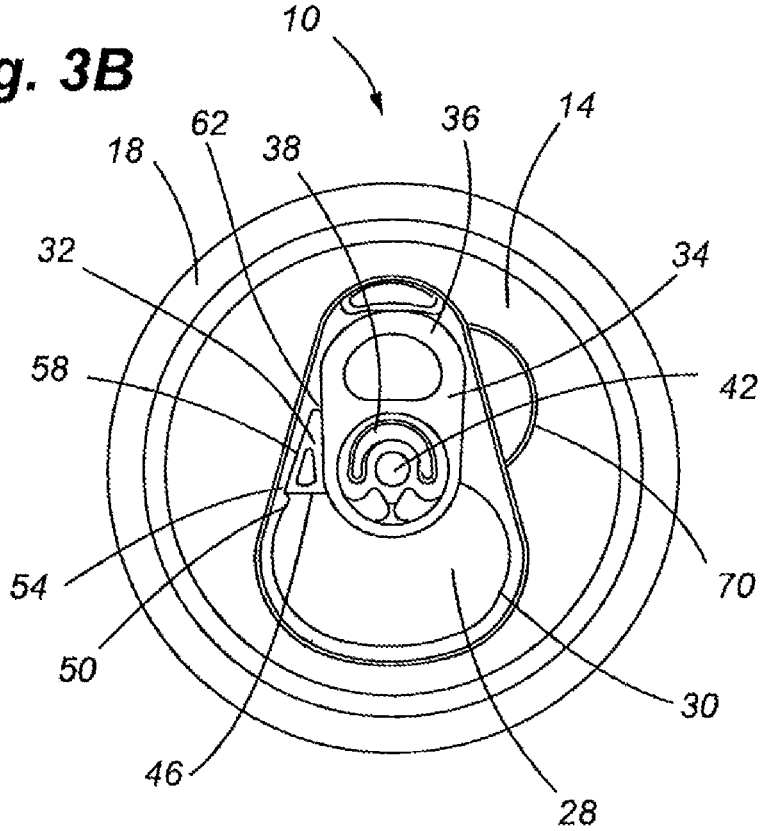
FIG. 3*b* is a top plan view of a metal end closure according to one embodiment wherein a gate of the first opening portion has been opened.

FIG. 3B is a top plan view of a metal end closure according to another embodiment of the invention, wherein a gate of the first opening portion has been opened. A central panel 14 is shown wherein a tab 34 has been lifted or tilted such that a gate has been sheared away from a portion of the panel 14 about a primary score line 30. Thus, a first opening area 28 has been opened to allow for contents to be poured or extracted from the container. As shown in FIG. 3B, a secondary gate 27 remains intact subsequent to the opening of a primary gate. As previously discussed, the secondary gate 27 and secondary opening area 32 are allowed to remain closed when a tab 34 is activated to open a primary opening area 28 and primary gate, due in part to a transition zone 54, primary score termination feature 50, and a primary score opening hinge 46. Accordingly, a central panel of the present invention provides a user with the option to selectively open only a first opening portion 28 where, for example, a vented feature is not desired.

Figure 3C:
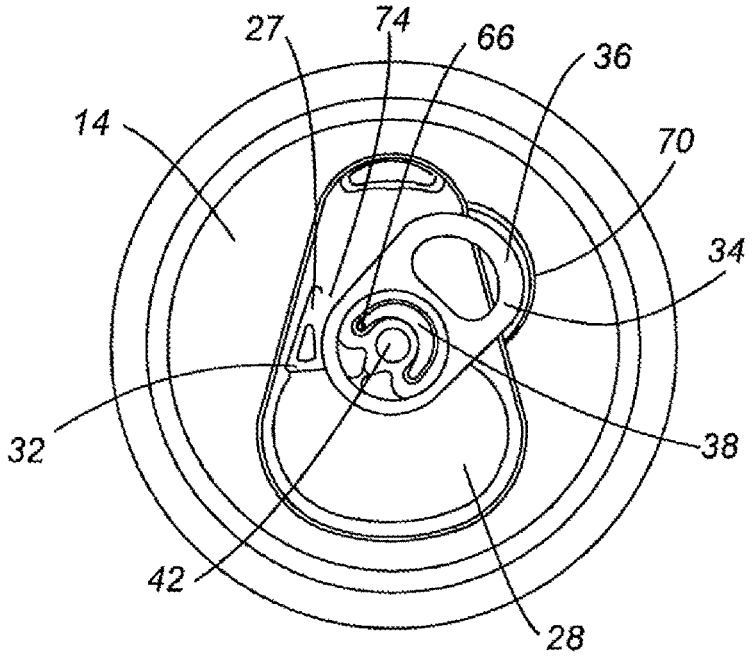
FIG. 3*c* is a top plan view of a metal end closure according to one embodiment wherein a gate of the first opening portion has been opened and a tab rotated to a second position.

Referring now to FIG. 3C, a top plan view of a metal end closure according to one embodiment is provided, where a gate of the first opening portion has been opened and a tab rotated to a second position. A metal end closure is provided wherein a first opening area 28 has been opened and a tab 34 rotated to a second position for subsequent opening of a secondary gate 27 and secondary opening area 32. As previously discussed, a tab 34 of the present invention may be rotatably affixed to a panel 14 via a rivet 42. Thus, the tab 34 is capable of being rotated to a position wherein a second lifting or tilting action applies a downward force upon a secondary gate 27. As further shown in FIG. 3C, rotation limiting means include, but are not limited to, a debossed profile 70 adapted to border, outline, receive, etc. the geometry of one end of a tab 34 of the present invention. Rotation limiting means may also include, for example, a positioning stop 66 disposed on the panel 14 which protrudes a predetermined height from a panel 14 and is adapted to receive and/or limit the rotation of a tab 34 by communicating with a rotational guide 38 formed within the tab 34. In one embodiment, rotational limiting means of the present invention 10 visually identify a preferred position at which a tab 34 should be rotated before tilting or activating a tab 34 and/or limit rotation to a desired predetermined range in order to fracture a secondary score line 62 and open a secondary opening area 32.

Figure 3D:
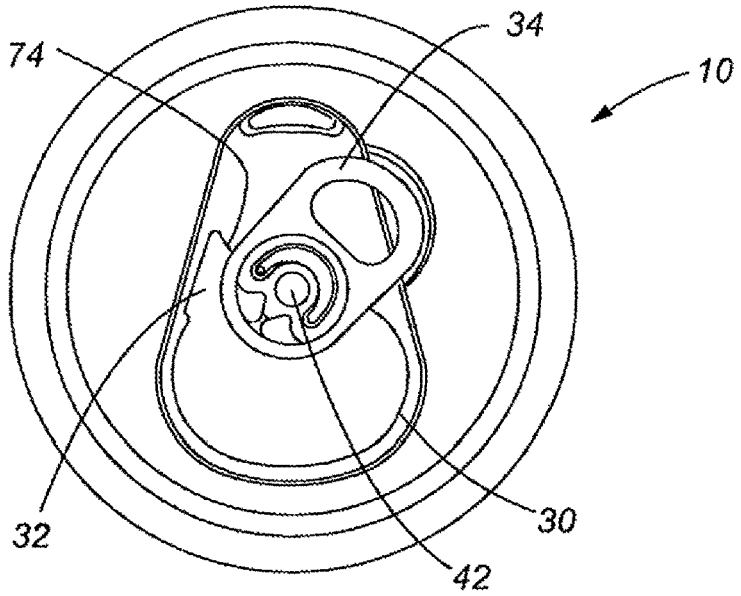
FIG. 3*d* is a top plan view of a metal end closure according to one embodiment wherein a gate of the first opening portion has been opened, a tab rotated to a second position, and a second opening portion opened.

Referring now to FIG. 3D, a top plan view of a metal end closure according to one embodiment is provided, wherein a gate of the first opening portion has been opened, a tab rotated to a second position, and a second opening portion opened. As shown, a rotatable tab 34 of the present invention has been rotated to a second position wherein the tab 34 has been lifted or tilted to apply a downward force on a second gate, thus shearing the gate from a secondary score line and deflecting the gate about a secondary score opening hinge 74. Once the tab 34 is rotated to an appropriate extent and/or degree to open the optional vented area 32, the tab 34 may be returned to a position substantially parallel with the panel 14. Contents housed within the container 10 may then be poured and/or consumed through the first opening portion 28 wherein the second opening area 32 facilitates flow of contents from the container 10 by increasing air flow into the container 10 and reducing vacuum pressure within the container and facilitating liquid flow from the container 10. Furthermore, as previously discussed and as shown in FIG. 3B it is not necessary for a user to open the secondary opening portion 32 of the present invention when a more conventional end closure opening is desired. One of ordinary skill in the art will recognize that various sized vent apertures 32 may be provided on the present invention. In one embodiment, the surface area of the optional vent aperture 32 may comprise an area approximately between 2 and 40 percent of an original score aperture area.

In an alternative embodiment, features of the present invention 10 may be incorporated into an end closure 14 that allows for complete opening of a vented aperture area 32 in a single opening or tab-tilting motion. Thus, in one embodiment, the present invention 10 does not comprise a transition zone 54 as shown and described herein. Rather, a secondary opening area 32 with a single secondary score opening hinge 74 may be provided wherein fracture of a primary score line 30 is not prevented from propagating into a secondary opening area 32 upon a first opening motion and/or force.

In one embodiment, a central panel is provided wherein at least one transition zone is provided between first and second opening areas which does not require rotation of a tab in order to sever a first and second score line. For example, a transition may be provided which requires a two distinct forces in order to sever first and second score lines wherein the two distinct forces are not necessarily segregated or defined by the rotation of a tab.

In one embodiment, a central panel is provided wherein the central panel has a primary score opening area between 0.50 and 0.75 square inches. In another embodiment, the primary opening area has an area between 0.575 and 0.625 square inches. In a more preferred embodiment, the primary opening area has an area of approximately 0.6111 square inches.

In one embodiment, a secondary opening area is provided having an area between 0.020 and 0.20 square inches. In another embodiment, a secondary opening area is provided having an area between 0.080 and 0.10 square inches. In a more preferred embodiment, a secondary opening area is provided having an area of approximately 0.0916 square inches.

In one embodiment, the total opening or open-able area, i.e. the combined area of all opening areas provided on a central panel, is between 0.25 and 1.5 square inches. In another embodiment, the total opening area of a central panel is between 0.60 and 0.80 square inches. In a more preferred embodiment, the total opening area of an end closure is approximately 0.7027 square inches. Thus, in one embodiment, a secondary opening area comprises approximately 13.03% of the total opening area provided on a central panel. However, as will be appreciated by one of ordinary skill in the art, primary and/or secondary opening areas may be varied in size. Thus, in various embodiments, a secondary opening area comprises between 5.0% and 25.0% of the total opening area.

In various embodiments, end closures provide a focal point for air entry into a container body, thus enhancing pourability and flow rates from a container. In various embodiments, secondary vent openings as shown and described herein increase the flow rate of contents from within a container and provide for up to a 30% faster flow of container contents when compared with conventional end closures having only a single opening area. In one particular embodiment, the time required to pour 12 fluid ounces of contents from an end closure of the present invention was approximately 4.35 seconds, compared to approximately 5.5 to 6.0 seconds as required for pouring the same or similar amounts of fluid from conventional end closures.

As will be recognized by one of ordinary skill in the art, area as used herein refers to the surface area of various opening portions as defined by their respective score line as shown and described herein.

Figure 4A:
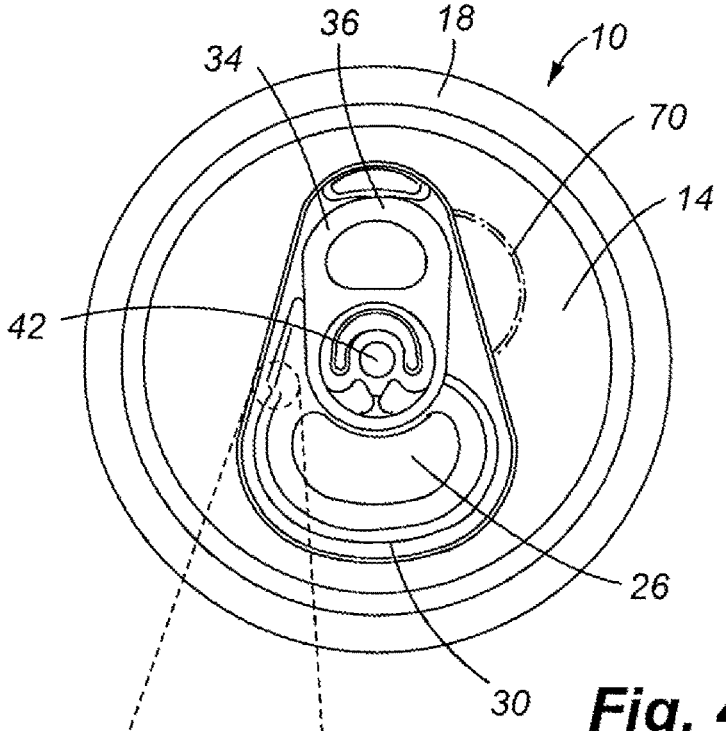
FIG. 4*a* is a top plan view of a metal end closure and a termination zone according to one embodiment.
Figure 4B:
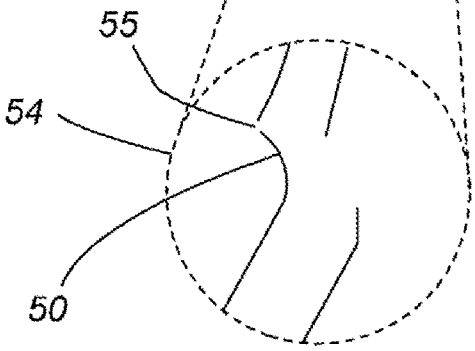
FIG. 4*b* is a detailed top plan view of a metal end closure and a termination zone according to an alternate embodiment.

Referring now to FIGS. 4A and 4B, top plan views of one embodiment of the present invention 10 are shown with a detailed view of a transition zone 54 provided. As shown in the detailed view, a primary score line 30 comprises a primary score termination feature 50 at one terminus. Primary score termination features 50 of the present invention dictate at least a general area at which the propagation of fracture of a primary score 30 will terminate. In one embodiment, as shown in FIG. 4, the primary score termination feature comprises a curvature in the primary score line 30 which represents a departure from the general path of the score line 30. In one embodiment, the termination feature 30 of the present invention is disposed within a transition zone 54 which further comprises a gap or void 55 which further inhibits propagation of a fracture of a first score line 30 into a second score line 58. In one embodiment, a void 55 of the present invention comprises a width approximately between 0.001 inches and 0.035 inches. In a preferred embodiment, a void 55 of the present invention comprises a width approximately between 0.005 inches and 0.025 inches. In a more preferred embodiment, a void 55 of the present invention comprises a width approximately between 0.012 inches and 0.015 inches.

Figure 5:
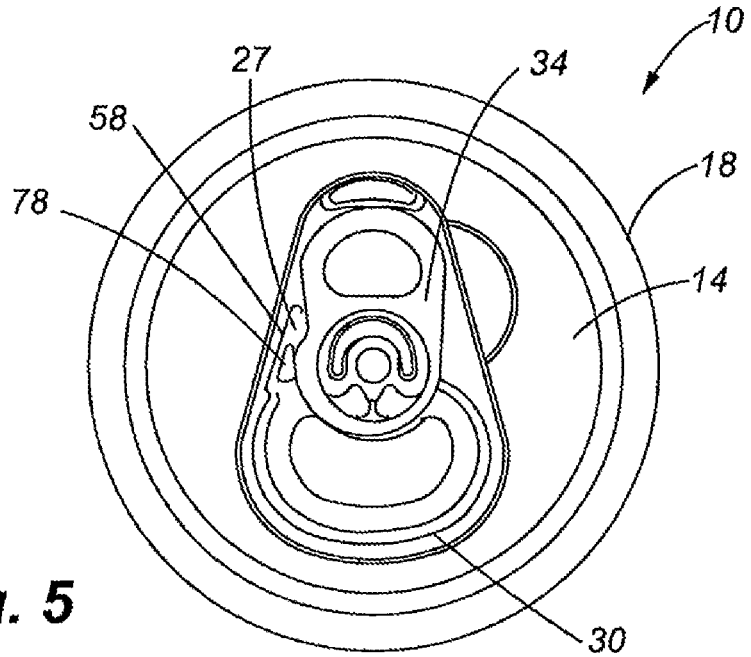
FIG. 5 is a top plan view of a metal end closure comprising an asymmetric tab according to an alternate embodiment.

Referring now to FIG. 5, a top plan view of a metal end closure comprising an asymmetric tab 34 is shown. The tab 34 is provided having an asymmetric geometry that is adapted to open a first 30 and secondary score feature 62 with a single or double opening operation (e.g. lifting of the tab 34). More specifically, the tab 34 includes an asymmetric protrusion or extension which extends over a secondary opening portion 32 that is adapted to contact a secondary gate 27 of a secondary opening area 32.

In one embodiment, the central panel 10 comprises a secondary opening portion 32 with a stiffening bead 78. One of skill in the art will recognize that the stiffening bead 78 disposed on the secondary opening area 32 may be comprised of any number of shapes (e.g. square, round, oval, polygonal, etc.). Embossed and/or debossed stiffening beads 78 may be disposed on secondary gate 27 of the present invention in order to stiffen the score panel 27 and facilitate proper rupture of the secondary score line 58 during opening. It will be recognized by one skilled in the art that the score panel design requires careful balancing of dimensions and design parameters in order to ensure that opening areas and other portions of a central panel will remain closed at appropriate times (e.g. during packaging and shipping operations) yet capable of opening under a reasonable amount of user-applied force. Accordingly, it is contemplated that a secondary opening area 32 of the present invention comprises one or more emboss and/or deboss beads.

In one embodiment, a stiffening bead area comprises a width approximately between 0.10 inches and 0.50 inches. In a preferred embodiment, a stiffening bead area comprises a width approximately between 0.20 inches and 0.40 inches. In a more preferred embodiment, a stiffening bead area comprises a width approximately between 0.225 inches and 0.275 inches. In one embodiment, a stiffening bead area comprises a length approximately between 0.20 inches and 0.60 inches. In a preferred embodiment, a stiffening bead area comprises a length approximately between 0.30 inches and 0.50 inches. In a more preferred embodiment, a stiffening bead area comprises a length approximately between 0.375 inches and 0.425 inches.

Figure 6:
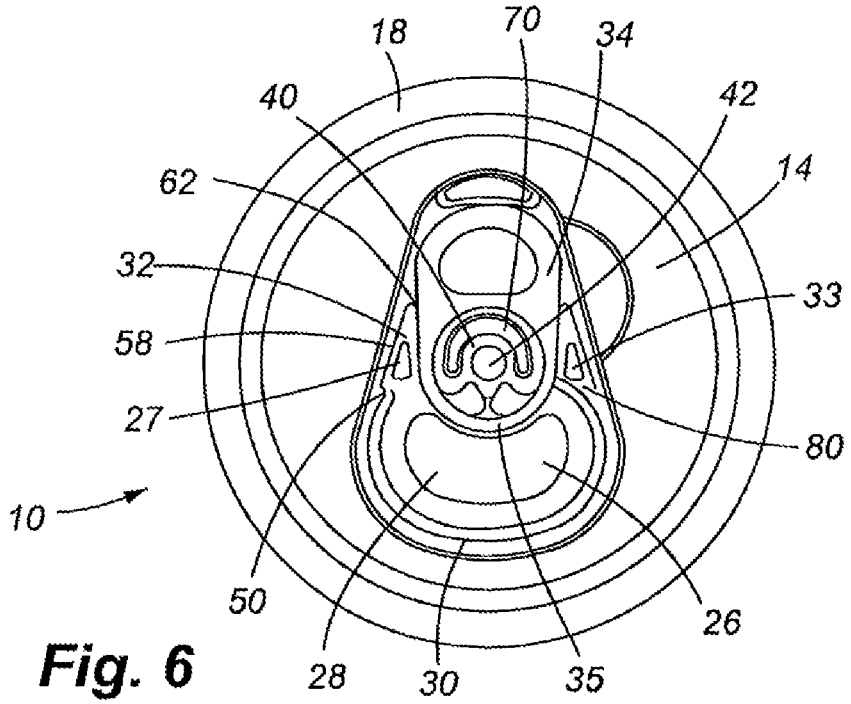
FIG. 6 is a top plan view of a metal end closure according to an alternate embodiment comprising two optional opening areas.

FIG. 6 is a top view of a metal end closure according to one embodiment wherein two optional vent opening features 32, 33 are provided. As shown, a first opening area 28 is disposed on a central panel with secondary 32 and third 33 opening areas disposed adjacent thereto. In embodiments, a third opening area 33 comprises the same features and functions as the secondary opening area 32 as described herein. Thus, in certain embodiments, a first opening area 28 may be opened by applying downward force via a nose portion 35 of a tab 34. The tab 34 may then be repositioned in a manner that allows for rotation of the tab 34. The tab 34 may then be rotated such that a nose portion of the tab 34 is disposed at least partially over a secondary 32 opening area and the tab 34 tilted or lifted to apply a downward pressure upon the secondary opening area 32 and separating a secondary gate 27. Subsequently, the tab 34 may again be tilted or restored to a position that allows for rotation of the tab and the tab 34 rotated such that it is at least partially disposed over the third opening area 33. The tab 34 may then tilted or lifted such that a nose portion of the tab 34 applies a downward pressure on the third opening portion 33 and separates a third or tertiary gate from the panel. The tab 34 may then remain in a final position or repositioned based on user preference and container contents poured smoothly as facilitated by the plurality of optional vent openings.

In certain embodiments, secondary and third gates may be opened without the need to rotate a tab 34. For example, in one embodiment, both a secondary gate 27 and third gate 80 may be severed from a panel 14 along their respective score lines due to the application of a force applied by the tilting or lifting of a tab 34 that is distinct from the tilting or lifting of tab 34 used in opening or severing a first gate 26. Features of the present invention allow for the tab 34 to be lifted under one distinct force or motion capable of severing a primary gate 26. Subsequent to the application of this force, an additional distinct force may be applied in series so as to open secondary and third gates.

Figure 7:
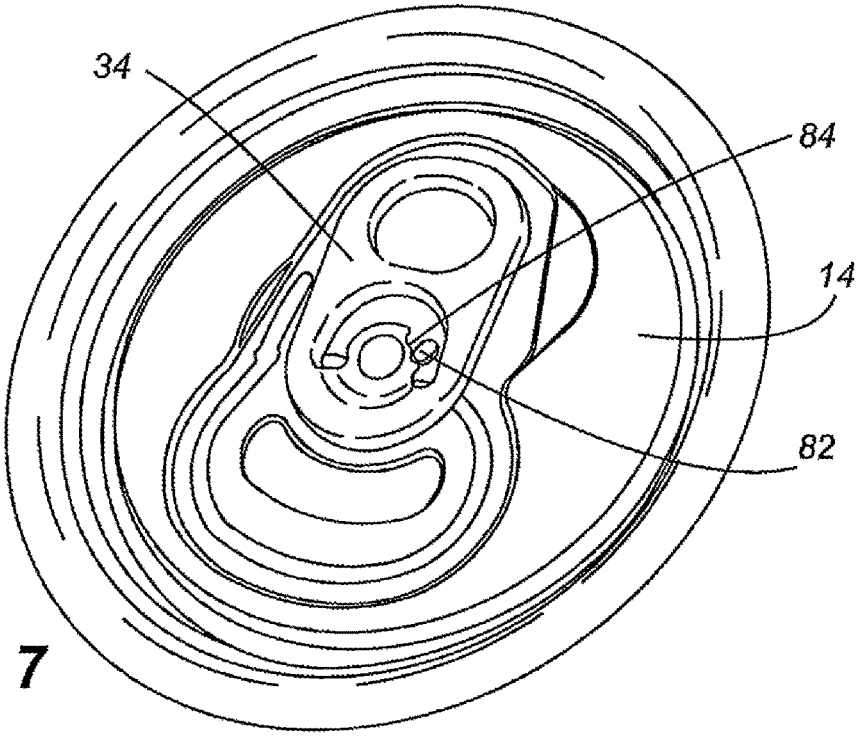
FIG. 7 is a top perspective view of a metal end closure according to an alternate embodiment comprising a rotation stop guide and a rivet island in a first position.
Figure 8:
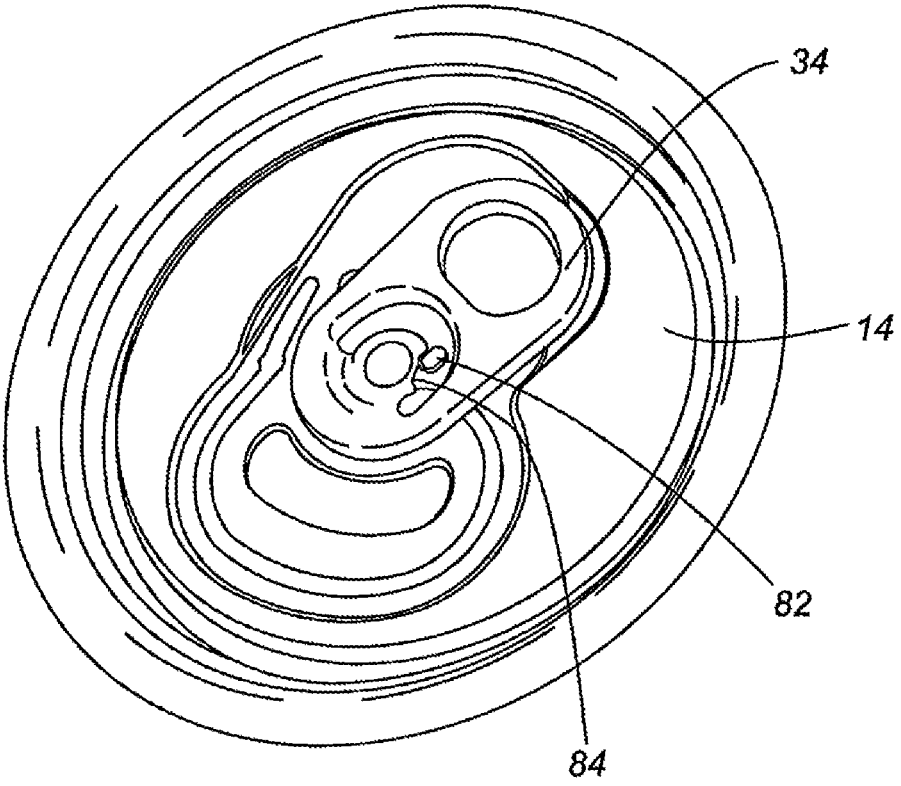
FIG. 8 is a top perspective view of a metal end closure according to one embodiment comprising a rotation stop guide and a rivet island in a second position.

Referring now to FIGS. 7 and 8, top perspective views of a metal end closure 10 according to one embodiment are provided. As shown, a rotational limiting means may be provided to prevent the rotation of a tab 34 beyond a certain position. Rotational limiting means of the present invention include, but are not limited to, protrusions and indentations of the panel 14 capable of communicating with portions of a tab 34. For example, as shown in FIG. 7, a protrusion may act as a rotation stop guide 82 adapted to interact or communicate with a portion of a rivet island 84. In certain embodiments, a peripheral portion of a segment of the rivet island 84 contacts a peripheral portion of the rotation guide 82 in a first position. Contact between the guide 82 and rivet island portion 84 in a first position corresponds to the tab 34 being disposed in a position adapted for opening of a primary opening area 28. Contact of a rotation guide 82 and a rivet island 84 facilitates the prevention of rotation beyond a certain point without constricting or limiting a tab's 34 ability to tilt and apply a downward pressure upon one or more opening areas.

As shown in FIG. 8, a tab 34 has been rotated to a maximum allowable extent as defined by a second point of contact between a rivet island portion 84 and a rotational guide 82. As will be recognized, the maximum amount of rotation allowed by the rivet island portion 84 and rotational guide 82 corresponds to a rotational positional of the tab 34 which is adapted for easy opening of one or more optional vent openings as described herein.

Figure 9:
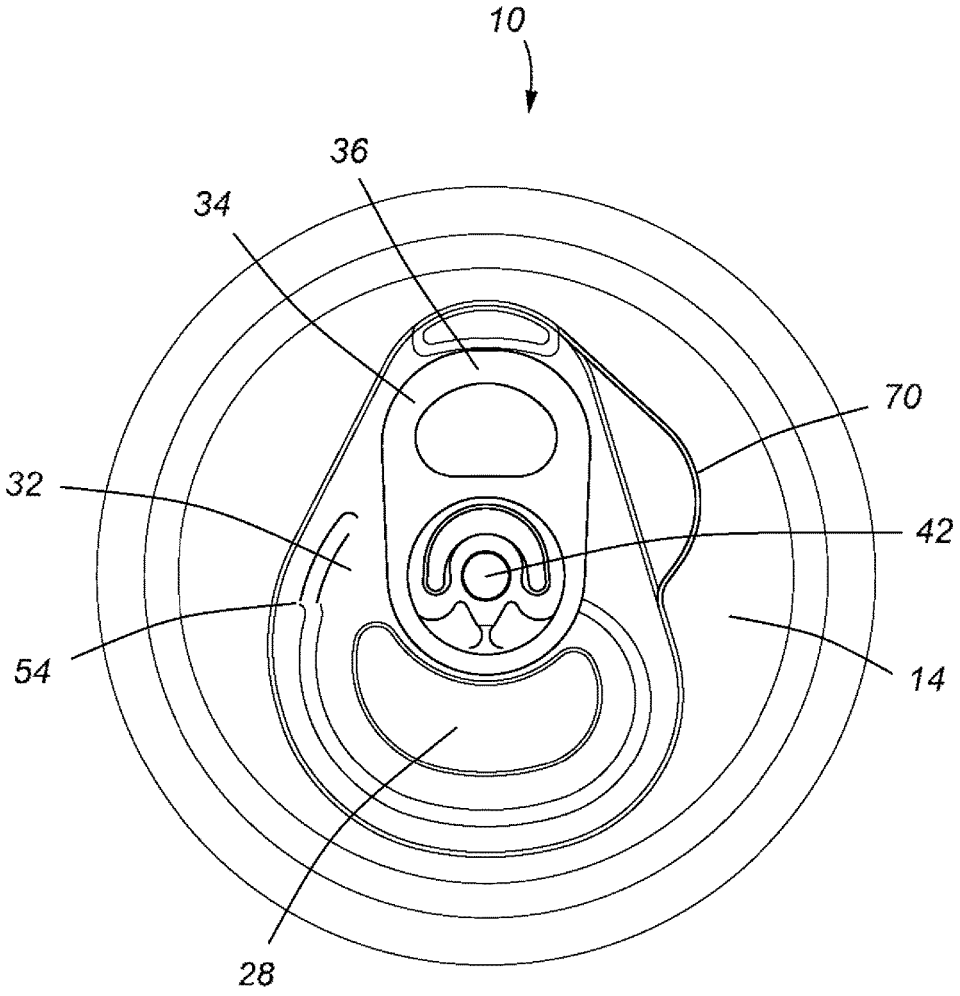
FIG. 9 is a top plan view of a metal end closure according to one embodiment comprising an alternatively-shaped deboss area and secondary score.

Referring now to FIG. 9, a top plan view of a metal end closure 10 is provided. This end closure 10 generally comprises a tab 34 with a tail 36 and a nose 35 wherein the tab 34 is interconnected to a panel 14 of the end closure 10 with a rivet 42. The panel 14 further comprises a deboss, or recessed area of the central panel 14, where various components are located including the rivet 42 and tab 34. A primary opening area 28, a secondary vent opening area 32 and a transition zone 54 are also disposed within the deboss area of the central panel 14.

However, as shown in FIG. 9, the deboss area is larger around the secondary vent opening area 32. This enlarged deboss area increases the surface area of both the primary opening area 28 and the secondary vent opening area 32 for improved flow rates as the contents in the container are poured. In some embodiments, the combined area of the primary opening area 28 and the secondary vent opening area 32 may be approximately between 0.600 square inches and 0.750 square inches. In a preferred embodiment, the combined area of the primary opening area 28 and the secondary vent opening area 32 is approximately 0.689 square inches.

A tab rotation guide 70 may be optionally provided on the central panel 14 to guide and/or limit the rotation of a tab 34. The tab rotation guide 70 is a deboss area that, in this embodiment, is at a different depth than the panel 14 and the area of the panel 14 where the rivet 42 and opening areas 28, 32 are disposed. The tab rotation guide 70 as shown in FIG. 9 extends to the top of a finger recess adjacent the tab's 34 tail 36, which provides a larger tab rotation guide 70.

Figure 10:
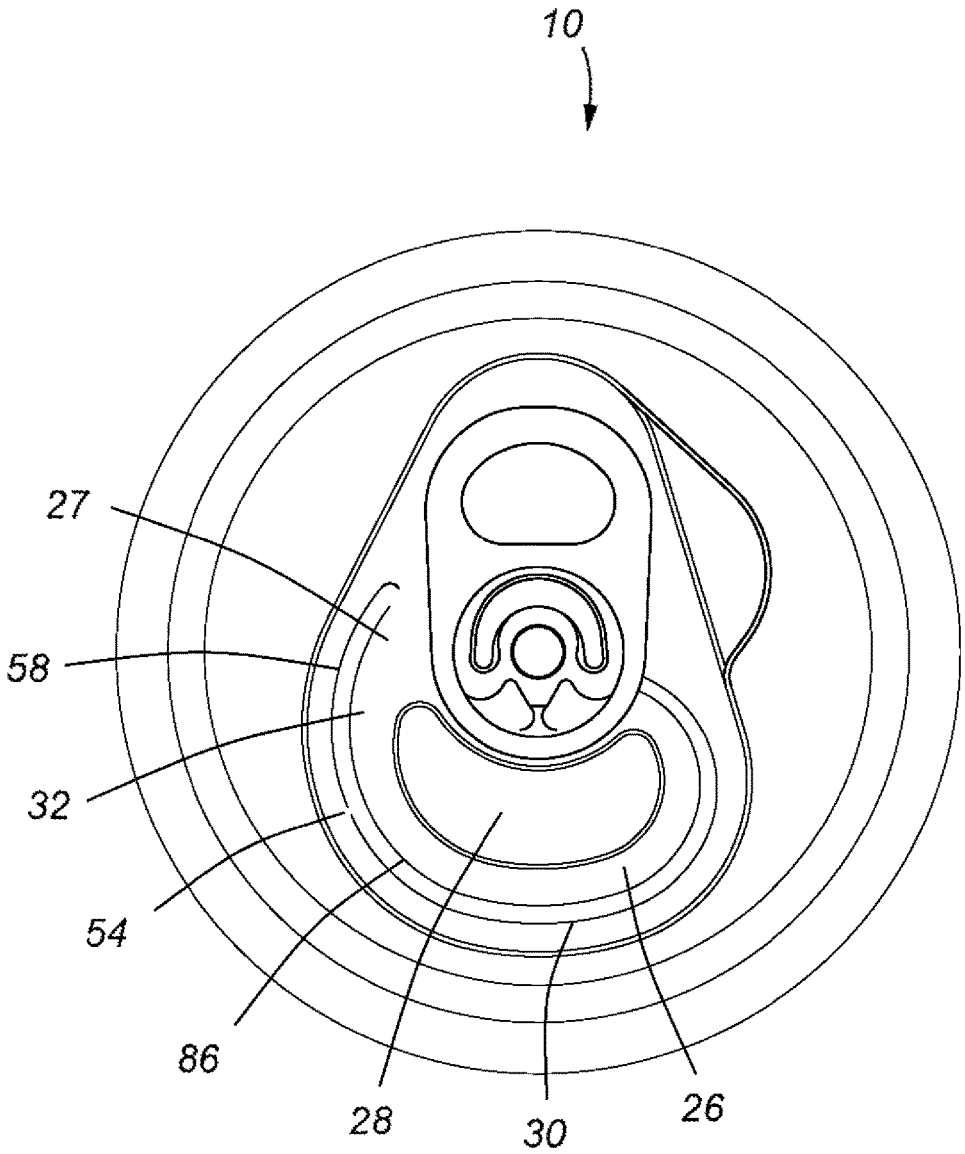
FIG. 10 is a top plan view of a metal end closure according to one embodiment comprising an alternatively shaped deboss area and an alternative primary and secondary score.

Referring now to FIG. 10, a top plan view of an alternative embodiment of a metal end closure 10 is provided wherein a primary score 30 and a secondary vent score 58 are oriented substantially along the same line or radius of curvature. In other words, the secondary vent score 58 is an extension of the primary score 30. Like other embodiments described herein, the end closure 10 of FIG. 10 comprises a primary score 30 that at least partially defines a primary opening area 28, and the primary score 30 fractures to open the primary opening area 28. Similarly, the end closure 10 of FIG. 10 comprises a secondary score 58 that at least partially defines the secondary vent opening area 32, and the secondary score 58 fractures to open the secondary vent opening area 32. The opening sequence of these areas 28, 32 generally comprises the steps of (a) lifting the tail end of the tab to generate a first downward force to shear the primary score 30, (b) lowering the tail end of the tab, at least partially, to its original position, (c) rotating the tab so a nose of the tab is generally positioned over the secondary vent opening area, and (d) lifting the tail end of the tab to generate a second downward force to shear the secondary score 58.

Another method comprises the steps of (a) positioning a pull tab to a first opening position; (b) lifting a tail end of a pull tab, which is interconnected to a central panel of the end closure with a rivet, to apply a first downward force on the first opening portion of the central panel to shear a first score line up to a transition portion and create a first opening in the central panel, wherein the first score line and the transition portion have distinct residuals; (c) repositioning the pull tab to a second opening position by rotating the pull tab in a plane which is substantially parallel to a plane of the central panel; and (d) lifting the tail end of the pull tab to apply a second downward force on the second vent opening portion to shear the transition portion positioned between the first score line and a second score line and to shear the second score line to form a second vent opening in the central panel, wherein the transition portion and the second score line have distinct residuals, and wherein the first opening portion and the second vent opening portion are integrally interconnected to form an opening larger than either the first opening or the second vent opening. Some methods may further comprise the steps of (a) repositioning the pull tab to a third opening position by rotating the pull tab in a plane which is substantially parallel to a plane of the central panel; and (b) lifting the tail end of the pull tab to apply a third downward force on a third opening portion to shear a third score line and to shear a transition portion positioned between the first score line and the third score line to form a third opening in the central panel.

An anti-fracture score 86 is generally offset from the scores 30, 58 at a substantially constant distance. Anti-fracture scores 86 may be optionally included in some embodiments of the invention to relieve stress areas around the primary score 30 and the secondary score 58 and prevent accidental opening of these scores 30, 58. The anti-fracture score 86 in this embodiment is continuous. However, it will be appreciated that the anti-fracture 86 score may also comprise two subscores similar to the arrangement between the primary score 30 and the secondary score 58. Further, the anti-fracture score 86 may comprise a transition zone or a transition zone check slot as described elsewhere herein. In various embodiments, the residual of the primary score 30, or thickness between the public side of the container and the content side of the container, may be approximately 0.0038 inches. In some embodiments, the residual of the secondary score 58 may be approximately between 0.0030 inches and 0.0050 inches.

In the embodiment shown in FIG. 10, a transition zone 54 between the primary vent score 30 and the secondary vent score 58 does not comprise a termination feature, and the primary score 30 and the secondary score 58 are positioned substantially along the same radius of curvature, meaning the primary score 30 and the secondary score 58 are substantially inline with each other. Stated another way, the two scores 30, 58 may be oriented about the same line, which may be a curve with a constant radius of curvature, a curve described by an n-order polynomial, a straight line, or any other line described elsewhere herein. In embodiments with and without termination features, the transition zone 54 may only be a partial interruption in the scores and not necessarily a complete interruption in the score. In some embodiments, the transition zone 54 may be a score that joins the primary score 30 to the secondary score 58. Thus, the transition zone 54 may be a check slot with a different depth, width, and/or cross sectional shape than one or both of the primary score 30 and the secondary score 58. Further, the length of the transition zone 54, which in some embodiments is distance between the ends of the primary and secondary scores 30, 58, may vary to impede or promote the opening of the secondary vent opening area 32. In some embodiments, the length of the transition zone 54, or void, may be between approximately 0.0050 inches to 0.0300 inches. In various embodiments, the length of the transition zone 54 may be approximately 0.0140 inches. In some embodiments where the transition zone 54 may be a check slot, the check slot depth may be between approximately 0.0000 inches and 0.0045 inches. In various embodiments, the check slot width may be between approximately 0.010 inches and 0.025 inches.

In some embodiments, the combined area of the primary opening area 28 and the secondary vent opening area 32 may be between approximately 0.600 square inches and 0.750 square inches. In various embodiments, the combined area of the primary opening area 28 and the secondary vent opening area 32 may be approximately 0.692 square inches.

Figure 11:
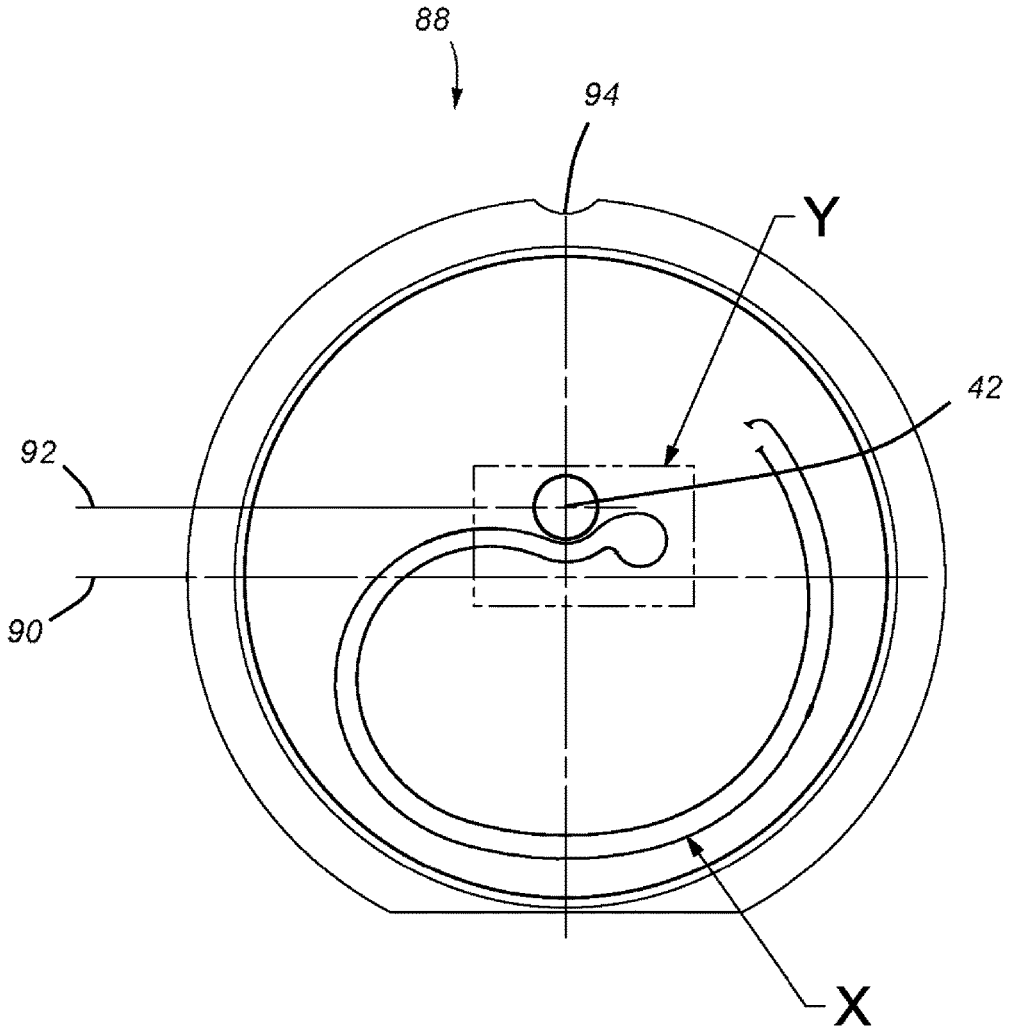
FIG. 11 is a top plan view of a score tool according to one embodiment with areas "X" and "Y"

Referring now to FIG. 11, a top plan view of a score tool 88 used to create the various features of the end closure 10 disclosed herein is provided. For the benefit of the reader, the terminology and reference characters used when described the features of the end closure 10 are used again to describe the score tool 88 that produces the same features. Even though, for example, a "score" may refer to a depression in the context of the end closure 10 and a protrusion in the context of the score tool 88. Dimensions and other aspects of the features described in reference to the end closure 10 may apply to the score tool 88, and vice versa.

The score tool 88 of FIG. 11 comprises several references lines. A horizontal insert line 90 is a horizontal reference line centered on the geometric center of the tool 88. A horizontal rivet line 92 is a horizontal reference line centered on the rivet 42. The offset between the two horizontal lines 90, 92 in this embodiment may be approximately 0.150 inches. A vertical insert line 94 is a vertical reference line centered on both the geometric center of the tool 88 and the rivet 42. Also shown in FIG. 11 are two areas "X" and "Y" that will be described in further detail below.

Figure 12A:
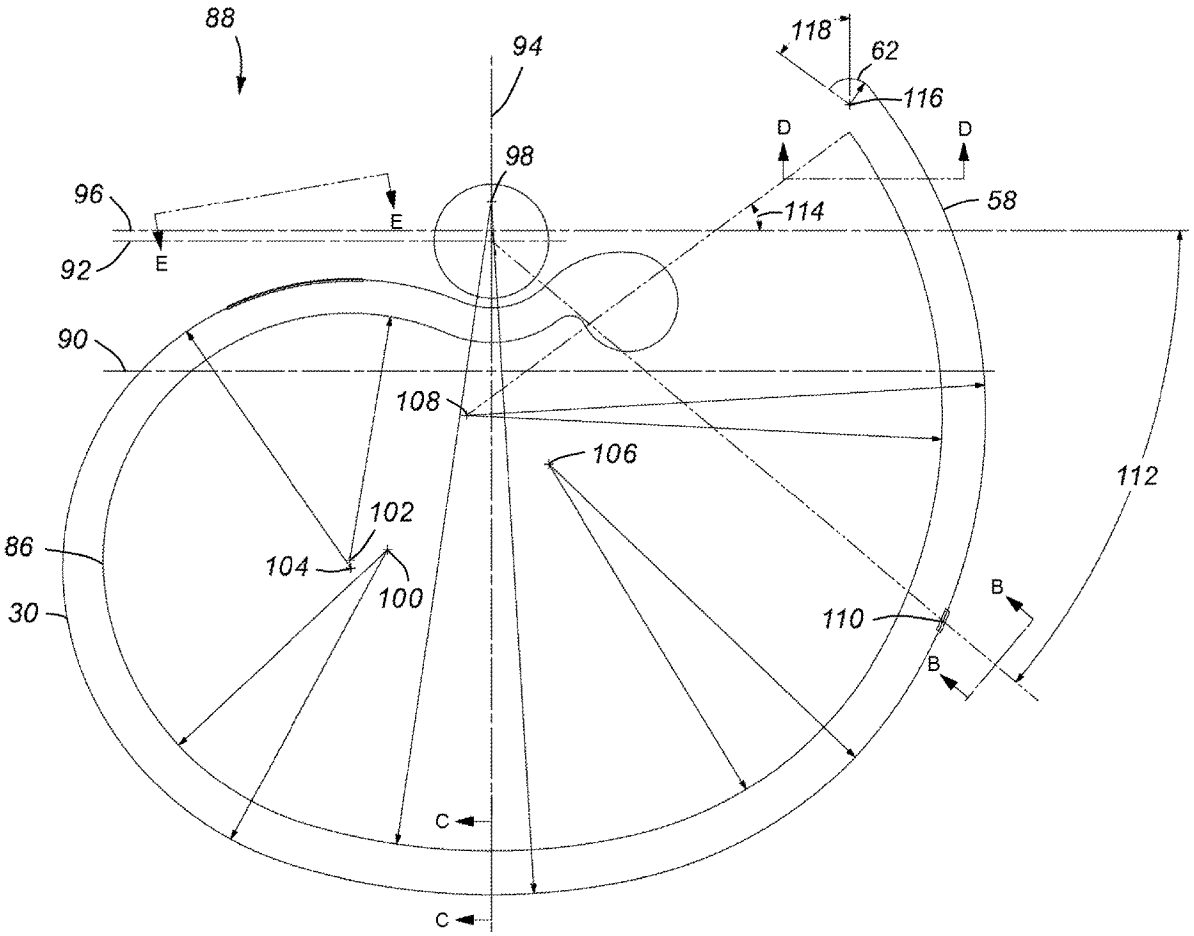
FIG. 12A is a top plan view of a score tool according to one embodiment wherein area "X" of the embodiment in FIG. 11 is shown in detail.

Referring now to FIG. 12A, a detailed top plan view of area "X" of the score tool 88 in FIG. 11 is provided. Various reference lines may be used to locate various datum points or reference points on the score tool 88. From these datum points, the geometric aspects of the tool features that produce the primary score 30 and the anti-fracture score 86 may be described. Reference lines 90, 92, and 94 are provided in FIG. 12A. Horizontal score line 96 is also provided wherein the offset between the horizontal score line 96 and the horizontal rivet line 92 may be between approximately 0.008 inches and 0.020 inches, and in some embodiments, the offset between the horizontal score line 96 and the horizontal rivet line 92 is approximately 0.012 inches.

A first datum point 98 may be provided on the vertical insert line 94, and in some embodiments, the first datum point 98 may be located on either side of the vertical insert line 94 by between approximately +/−0.01 inches. The first datum point 98 may be offset above the horizontal score line 96 by between approximately 0.030 inches to 0.040 inches, and in some embodiments, the first datum point 98 is offset above the horizontal score line 96 by approximately 0.034 inches. The tool feature that produces the primary score 30 has a radius of curvature from the first datum point 98 as shown in FIG. 12A that may be between approximately 0.750 inches and 0.850 inches, and in some embodiments, the tool feature's radius of curvature from the first datum point 98 is approximately 0.800 inches. The tool feature that produces the anti-fracture score 86 has a radius of curvature from the first datum point 98 as shown in FIG. 12A that may be between approximately 0.700 inches and 0.800 inches, and in some embodiments, the tool feature's radius of curvature from the first datum point 98 is 0.750 inches.

A second datum point 100 may be offset from the vertical insert line 94 by between approximately 0.080 inches and 0.200 inches, and in some embodiments, the second datum point 100 is offset from the vertical insert line 94 by approximately 0.120 inches. The second datum point 100 may be offset from the horizontal score line 96 by between approximately 0.3000 inches and 0.4200 inches, and in some embodiments, the second datum point 100 is offset from the horizontal score line 96 by approximately 0.3685 inches. The tool feature that produces the primary score 30 has a radius of curvature from the second datum point 100 as shown in FIG. 12A that may be between approximately 0.300 inches and 0.450 inches, and in some embodiments, the tool feature's radius of curvature from the second datum point 100 is approximately 0.380 inches. The tool feature that produces the anti-fracture score 86 has a radius of curvature from the second datum point 100 as shown in FIG. 12A that may be between approximately 0.300 inches and 0.400 inches, and in some embodiments, the tool feature's radius of curvature from the second datum point 100 is approximately 0.330 inches.

A third datum point 102 may be offset from the vertical insert line 94 by between approximately 0.1200 inches and 0.2000 inches, and in some embodiments, the third datum point 102 is offset from the vertical insert line 94 by approximately 0.1634 inches. The third datum point 102 may be offset from the horizontal score line 96 by between approximately 0.3400 inches and 0.4200 inches, and in some embodiments, the third datum point 102 may be offset from the horizontal score line 96 is approximately 0.3804 inches. The tool feature that produces the anti-fracture score 86 has a radius of curvature from the third datum point 102 as shown in FIG. 12A that may be between approximately 0.250 inches and 0.300 inches, and in some embodiments, the tool feature's radius of curvature from the third datum point 102 is approximately 0.285 inches.

A fourth datum point 104 may be offset from the vertical insert line 94 by between approximately 0.120 inches and 0.200 inches, and in some embodiments, the fourth datum point 104 is offset from the vertical insert line 94 by approximately 0.162 inches. The fourth datum point 104 may be offset from the horizontal score line 96 by between approximately 0.3400 inches and 0.4200 inches, and in some embodiments, the fourth datum point 104 is offset from the horizontal score line 96 by approximately 0.3897 inches. The tool feature that produces the primary score 30 has a radius of curvature from the fourth datum point 104 as shown in FIG. 12A may be between approximately 0.300 inches and 0.360 inches, and in some embodiments, the tool feature's radius of curvature from the fourth datum point 104 is approximately 0.333 inches.

A fifth datum point 106 may be offset from the vertical insert line 94 by between approximately 0.030 inches and 0.100 inches, and in some embodiments, the fifth datum point 106 is offset from the vertical insert line 94 by approximately 0.066 inches. The fifth datum point 106 may be offset from the horizontal score line 96 by between approximately 0.2200 inches and 0.3000 inches, and in some embodiments, the fifth datum point 106 is offset from the horizontal score line 96 by approximately 0.2689 inches. The tool feature that produces the primary score 30 has a radius of curvature from the fifth datum point 106 as shown in FIG. 12A that may be between approximately 0.400 inches and 0.600 inches, and in some embodiments, the tool feature's radius of curvature from the fifth datum point 106 is approximately 0.490 inches. The tool feature that produces the anti-fracture score 86 has a radius of curvature from the fifth datum point 106 as shown in FIG. 12A that may be between approximately 0.400 inches and 0.500 inches, and in some embodiments, the tool feature's radius of curvature from the fifth datum point 106 is approximately 0.440 inches.

A sixth datum point 108 may be offset from the vertical insert line 94 by between approximately 0.0200 inches and 0.0360 inches, and in some embodiments, the sixth datum point 108 is offset from the vertical insert line 94 by approximately 0.0287 inches. The sixth datum point 108 may be offset from the horizontal score line 96 by between approximately 0.150 inches and 0.270 inches, and in some embodiments, the sixth datum point 108 is offset from the horizontal score line 96 by approximately 0.213 inches. The tool feature that produces the secondary score 58 has a radius of curvature from the sixth datum point 108 as shown in FIG. 12A that may be between approximately 0.500 inches and 0.700 inches, and in some embodiments, the tool feature's radius of curvature from the sixth datum point 108 is approximately 0.600 inches. The tool feature that produces the anti-fracture score 86 has a radius of curvature from the sixth datum point 108 as shown in FIG. 12A that may be between approximately 0.500 inches and 0.600 inches, and in some embodiments, the tool feature's radius of curvature from the sixth datum point 108 is approximately 0.550 inches.

A transition check slot 110 is a type of transition zone provided on the primary score 30. The tool feature that produces the transition check slot 110 is shown in FIG. 12A. The transition check slot 110 is located on the primary score 30 at a transition check slot angle 112 measured from the horizontal score line 96. In some embodiments, the transition check slot angle 112 may be approximately 40 degrees. In various embodiments, the transition check slot angle 112 may be between approximately 90 degrees and −40 degrees. In yet more embodiments, the transition check slot angle 112 may be between approximately 60 degrees and 20 degrees.

As described elsewhere herein, the transition check slot 110 can slow down the propagation of a fracture along the primary score 30. This inhibiting effect provided by the transition check slot 110 may simply slow down the propagation speed or velocity of the fracture along the primary score 30. In some embodiments, the transition check slot 110 completely stops or inhibits propagation of the fracture along the primary score 30. In some embodiments, the user operates the end closure in an open-rotate-open fashion. This means that in one action the user fractures the primary score 30 up to the transition check slot 110, at which point the transition check slot 110 sufficiently stops propagation of the fracture. Then, the user returns the tail portion of the pull tab toward its original position, and the user rotates the pull tab past the transition check slot 110 and over the secondary score 58. The user may then lift the tail portion of the pull tab again to fracture the secondary score 58, or the portion of the primary score 30 beyond the transition check slot 110 that has not yet been fractured.

It will be appreciated that more than one check slot 110 may be located in a transition zone between the primary score 30 and the secondary score 58 or even on the primary score 30 and secondary score 58 themselves. For example, a first check slot 110 may be located on the primary score 30 before the transition zone to help slow propagation of a fracture along the primary score 30. Then, another check slot 110 located between the primary score 30 and the secondary score 58 may completely stop propagation of the fracture along the primary score 30 before the secondary score 58. This interruption can provide time for a user to optionally reposition a pull tab over the secondary opening and optionally fracture the secondary score 58.

The anti-fracture score 86 may have a terminus that is governed by an anti-fracture score angle 114 originating from the sixth datum point 108 and oriented relative to the horizontal score line 96. In some embodiments, the anti-fracture score angle 114 may be between approximately 20 degrees and 60 degrees. In various embodiments, the anti-fracture score angle 114 may be approximately 36.5 degrees.

A ninth datum point 116 may be offset from the vertical insert line 94 by between approximately 0.3500 inches and 0.4800 inches, and in some embodiments, the ninth datum point 116 is offset from the vertical insert line 94 by approximately 0.4143 inches. The ninth datum point 116 may be offset from the horizontal score line 96 by between approximately 0.1000 inches and 0.2000 inches, and in some embodiments, the ninth datum point 116 is offset from the horizontal score line 96 by approximately 0.1457 inches. The feature that produces a secondary score termination feature 62 has a radius of curvature from the ninth datum point 120 as shown in FIG. 12A that may be between approximately 0.020 inches and 0.010 inches, and in some embodiments the tool feature's radius of curvature from the ninth datum point 120 is approximately 0.030 inches. The terminus of the secondary score termination feature 62 may be governed by a termination feature angle 118 oriented relative to a vertical plane or line that is parallel with the vertical insert line 94. In some embodiments, the termination feature angle 118 may be between approximately 40 degrees and 70 degrees. In various embodiments, the termination feature angle 118 is approximately 54 degrees.

Also shown in FIG. 12A are four cross sectional lines, B-B, C-C, D-D, and E-E taken at various points of the score tool 88. Cross sectional line B-B relates to the transition check slot 110 and is described in further detail in FIG. 12B. Cross sectional line C-C relates to the primary score 30 and the anti-fracture score 86 and is described in further detail in FIG. 12C. Cross sectional line D-D relates to the secondary score 58 and the anti-fracture score 86 and is described in further detail in FIG. 12D. Cross sectional line E-E relates to a check slot positioned near the rivet of the end closure and is described in further detail in FIG. 12E.

Figure 12C:
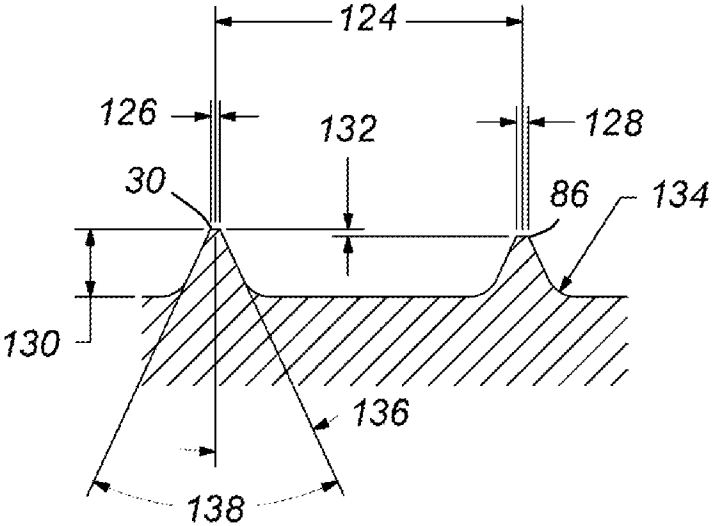
FIG. 12C is a cross sectional view of a score tool according to one embodiment taken along line C-C of the embodiment in FIG. 12A.
Figure 12B:
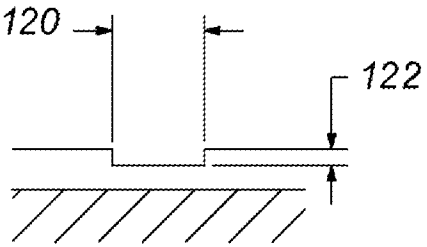
FIG. 12B is a cross sectional view of a score tool according to one embodiment taken along line B-B of the embodiment in FIG. 12A.

Referring now to FIG. 12B, a cross sectional view of the tool feature that produces the transition check slot 110 in FIG. 12A is provided. A transition check slot width 120 represents the extent of the transition check slot 110 along the primary score. In some embodiments, the transition check slot width 120 may be between approximately 0.01 inches and 0.030 inches. In various embodiments, the check slot width is approximately 0.025 inches. The transition check slot depth 122 represents the additional residual of the transition check slot 110 over the primary score. The residual is the amount of material between the public side of the end closure and the content side of the end closure. The transition check slot 110 typically has a larger residual to slow or impede the propagation of a fracture along a score such as the primary score. In some embodiments, the transition check slot depth 122 may be between approximately 0.0010 inches and 0.0100 inches. In various embodiments, the transition check slot depth 122 is approximately 0.0044 inches.

As discussed elsewhere herein, the transition check slot 110 may have various cross sectional profiles. For example, the transition check slot's 110 profile may be curved and continuous with the primary score instead of the discrete change in residual depth as shown in FIG. 12B. The profile of the transition check slot 110 may be substantially defined by a radius of curvature, a n-order polynomial, etc. The transition check slot 110 may also have various cross sectional profiles when viewed along the length of the primary score and the check slot.

Referring now to FIG. 12C, a cross sectional view of the tool features that produce the scores 30, 86 taken along line C-C in FIG. 12A is provided. The resulting primary score 30 created by the score tool 88 in FIG. 12C is deeper than the anti-fracture score 86. Therefore, the primary score 30 portion of the score tool 88 is larger than the anti-fracture score 86 portion. The score pitch 124 between the primary score 30 and the anti-fracture score 86 may be approximately 0.050 inches. The primary score width 126 may be between approximately 0.0010 inches and 0.0015 inches, and the anti-fracture score width 128 may be between approximately 0.0015 inches and 0.0020 inches.

The primary score depth 130, and accordingly the height of the tool feature that creates the primary score, may be between approximately 0.0100 inches and 0.0110 inches. The score offset 132 represents the difference in score depth between the primary score 30 and the anti-fracture score 86 since the anti-fracture score 86 is typically shallower than the primary score 30. The score offset 132 may be between approximately 0.0020 inches and 0.0022 inches. The score radius 134 is the radiused edge between the tool feature that produces the anti-fracture score 86 and the surface of the tool, which in this embodiment has a radius of curvature of approximately 0.005 inches. The angle that one wall of the tool feature that produces the primary score 30 forms with the rest of the tool is the score side angle 136, which in this embodiment may be approximately 25°. The angle that two walls of the tool feature that produces the primary score 30 form with the tool is the overall score angle 138, and since the walls of the tool feature are bilaterally symmetric in this embodiment, the overall score angle 138 may be approximately 50°.

Figure 12E:
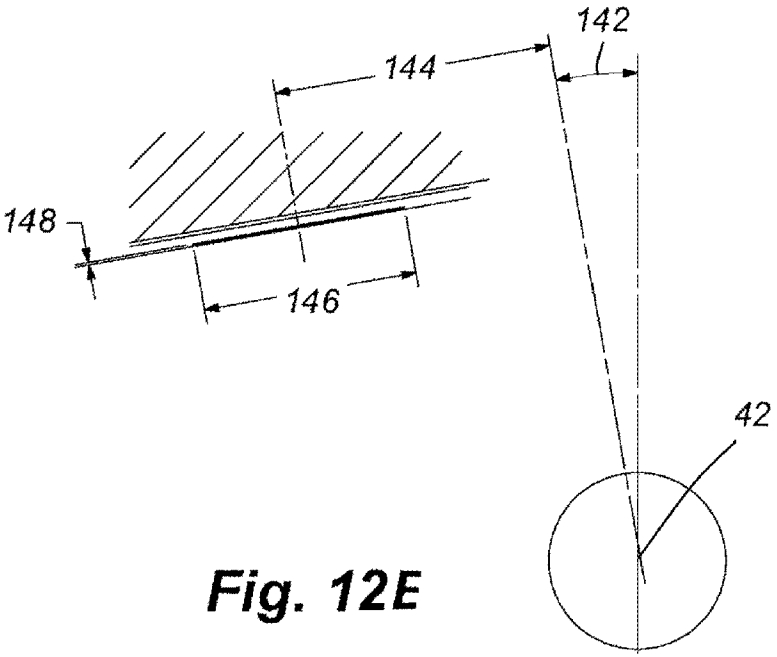
FIG. 12E is a cross sectional view of a check slot portion of a score tool according to one embodiment taken along line E-E of the embodiment in FIG. 12A.
Figure 12D:
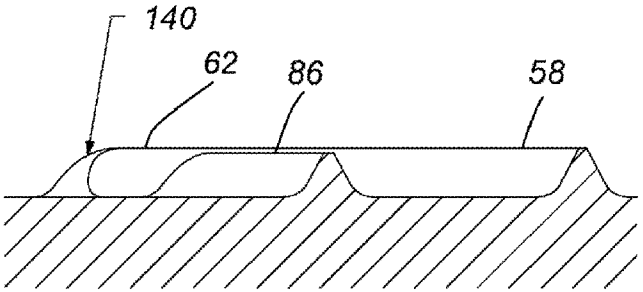
FIG. 12D is a cross sectional view of a score tool according to one embodiment taken along line D-D of the embodiment in FIG. 12A.

Referring now to FIG. 12D, a cross sectional view of the tool features that produce scores 58, 86 taken along line D-D of FIG. 12A is provided. The tool feature that produces the anti-fracture score 86 is shown terminating and descending back into the tool (or the surface of the end closure in the resulting end closure). Additionally, the tool feature that produces the second score 58 is shown transitioning to the secondary score termination feature 62 before descending back into the tool (or the surface of the end closure in the resulting end closure). In the embodiment in FIG. 12D, the tool feature that produces the secondary score 58 ends in a feature radius 140 that has a radius of curvature between approximately 0.010 inches and 0.015 inches.

Referring now to FIG. 12E, a cross sectional view of the tool feature that produces an optional check slot portion of the primary score taken along line E-E of FIG. 12A is provided. The cross sectional line is offset from the vertical insert line by a check slot angle 142, which in this embodiment may be approximately 10°. Using this check slot angle 142, the center of the tool feature that produces the check slot is offset from the rivet 42 by a check slot midpoint 144, which may be approximately 0.208 inches in this embodiment. The check slot length 146, which is the length of the tool feature in FIG. 12E, may be approximately 0.160 inches. The check slot generally has a shallower depth than the primary score in order to inhibit propagation of the fracture along the primary score. The check slot relative depth 148 is the difference in depth between the primary score and the check slot. In this embodiment, the check slot relative depth 148 may be between approximately 0.0016 inches and 0.0018 inches.

Figure 13C:
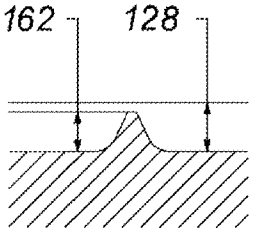
FIG. 13C is a cross sectional view of a score tool according to one embodiment taken along line C-C of the embodiment in FIG. 13A.
Figure 13B:
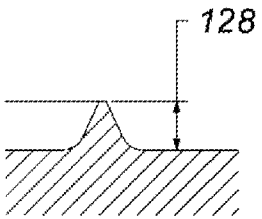
FIG. 13B is a cross sectional view of a score tool according to one embodiment taken along line B-B of the embodiment in FIG. 13A.
Figure 13A:
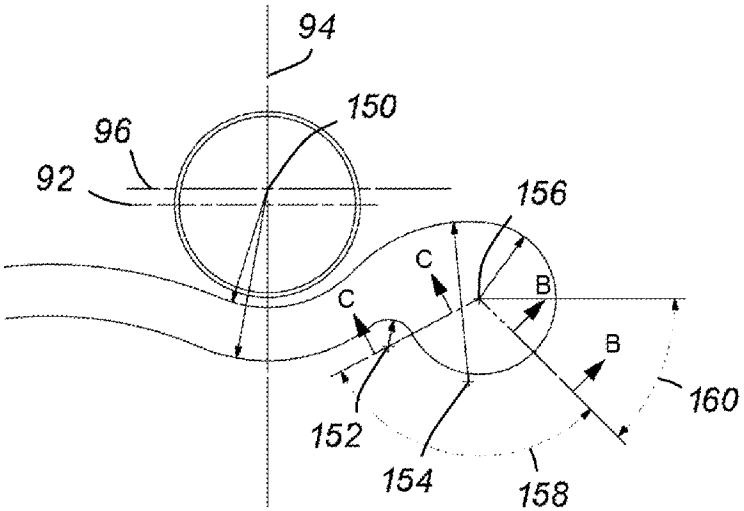
FIG. 13A is a top plan view of a score tool according to one embodiment wherein area "Y" of the embodiment in FIG. 11 is shown in detail.

Referring now to FIG. 13A, a detailed top plan view of area "Y" of the score tool 88 in FIG. 11 is provided. The horizontal rivet line 92, the vertical insert line 94, and the horizontal score line 96 are provided as references for various datum points on the tool. A tenth datum point 150 is located at the intersection of the vertical insert line 94 and the horizontal score line 96. The tool feature that produces the primary score 30 has a radius of curvature from the tenth datum point 150 that may be approximately 0.089 inches. In some embodiments, this radius of curvature may be between approximately 0.020 inches and 0.150 inches. The tool feature that produces the anti-fracture score 86 has a radius of curvature from the tenth datum point 150 that may be approximately 0.129 inches. In some embodiments, this radius of curvature may be between approximately 0.080 inches and 0.180 inches.

An eleventh datum point 152 may be offset from the vertical insert line 94 by approximately 0.0908 inches and may be offset from the horizontal score line 96 by approximately 0.1181 inches. The tool feature that produces the anti-fracture score 86 has a radius of curvature from the eleventh datum point 152 that may be approximately 0.020 inches. In some embodiments, this radius of curvature may be between approximately 0.010 inches and 0.050 inches.

A twelfth datum point 154 may be offset from the vertical insert line 94 by approximately 0.1508 inches and may be offset from the horizontal score line 96 by approximately 0.1447 inches. The tool feature that produces the primary score 30 has a radius of curvature from the twelfth datum point 154 that may be approximately 0.120 inches. In some embodiments, this radius of curvature may be between approximately 0.050 inches and 0.200 inches.

A thirteenth datum point 156 may be offset from the vertical insert line 94 by approximately 0.1589 inches and may be offset from the horizontal score line 96 by approximately 0.0822 inches. The tool feature that produces the primary score 30 has a radius of curvature from the thirteenth datum point 156 that may be approximately 0.057 inches. In some embodiments, this radius of curvature may be between approximately 0.020 inches and 0.100 inches.

Two cross sectional lines, B-B and C-C, are oriented about the thirteenth datum point 156, and these cross sectional lines show the transition between the primary score and the anti-fracture score. Cross sectional line B-B corresponds to the tool feature that produces the primary score, and cross sectional line C-C corresponds to the tool feature that produces the anti-fracture score. The first angle 158 is the angle between the two cross sectional lines, and in this embodiment the first angle may be approximately 107.21°. A second angle 160 orients the first angle relative to the horizontal score line 96, and in this embodiment, the second angle may be approximately 45°.

Referring now to FIG. 13B, a cross sectional view of the tool feature that produces the primary score taken along line B-B is provided. As described previously, the primary score depth 128, and accordingly the height of the tool feature that creates the primary score, may be between approximately 0.0100 inches and 0.0110 inches.

Referring now to FIG. 13C, a cross sectional view of the tool feature that produces the anti-fracture score taken along line C-C is provided. The anti-fracture score depth 162 may be between approximately 0.0088 inches and 0.0100 inches. The transition between the anti-fracture score of FIG. 13C and the primary score of FIG. 13B can take a variety of shapes. The transition may simply be a linear transition between the two score depths. However, it will be appreciated that the transition may be curved, curved about a radius, an n-order polynomial, a discrete jump between the two score depths without a transition, etc.

Figure 14C:
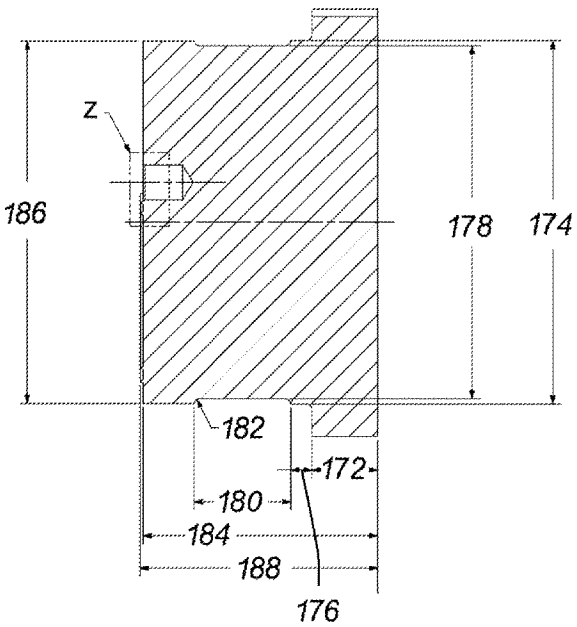
FIG. 14C is a cross sectional view of a score tool according to one embodiment taken along line C-C of the embodiment in FIG. 14A.
Figure 14A:
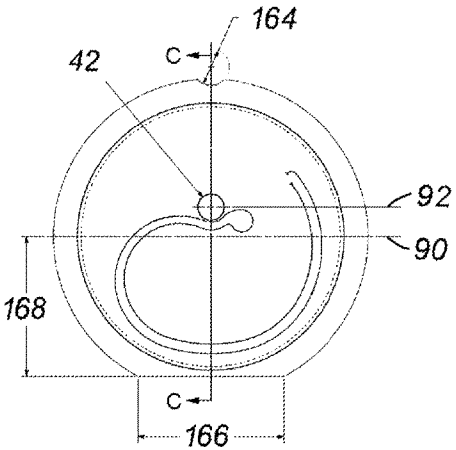
FIG. 14A is a top plan view of a score tool according to one embodiment.

Referring now to FIG. 14A, a top plan view of a tool with the physical characteristics to form a primary score, a secondary score, and a notch 164 is provided. The notch 164 allows the tool to be oriented when the tool is used during production. The horizontal insert line 90 and the horizontal rivet line 92 are provided on the top surface of the tool. The notch 164 is positioned on the vertical insert line and may be offset from the horizontal insert line 90 by approximately 0.875 inches. The radius of the notch 164 may be between approximately 0.1885 inches and 0.1890 inches. Also provided in FIG. 14A is a cross sectional line C-C which is positioned on the vertical insert line. This cross sectional line C-C is described in more detail below with respect to FIG. 14C.

Also shown in FIG. 14A is an indexing feature, which in this embodiment is a flattened edge of the tool. The index feature width 166 may be approximately 0.75 inches, and the index feature offset 168 may be approximately 0.72 inches.

Figure 14B:
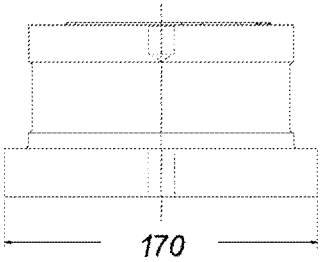
FIG. 14B is a side elevation view of the score tool in FIG. 14A according to one embodiment.

Referring now to FIG. 14B, a side elevation view of the score tool in FIG. 14A is provided. The bottom portion of the tool has a widened, flanged base. In the embodiment in FIG. 14B, the tool flange width 170 may be between approximately 1.623 inches and 1.625 inches.

Referring now to FIG. 14C, a cross sectional view of the score tool taken along line C-C of FIG. 14A is provided. The flange of the tool described above in reference to FIG. 14B has a tool flange height 172 that may be approximately 0.25 inches. Moving leftward in FIG. 14C, the next portion of the tool is the lip. The tool lip width 174 is approximately 1.380 inches, and the tool lip height 176 may be approximately 0.08 inches above the tool flange. The next part of the tool is the gap. The tool gap width 178 may be approximately 1.34 inches, the tool gap height 180 may be approximately 0.37 inches, and a tool gap radius 182 may have a radius of curvature of approximately 0.02 inches.

Next, the overall height of the tool 184 without consideration of the scores may be approximately 0.8933 inches. The overall width of the tool 186 is between approximately 1.374 inches and 1.375 inches. The overall height of the tool 188 including the primary score is approximately 0.9043 inches. Also included in FIG. 14C is detail area "Z" which corresponds to the rivet portion of the tool.

Figure 14E:
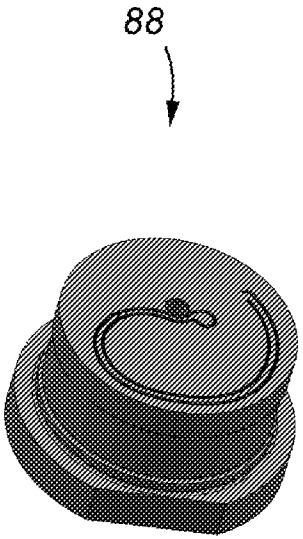
FIG. 14E is a perspective view of a score tool according to one embodiment.
Figure 14D:
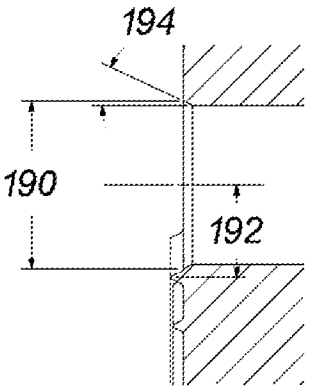
FIG. 14D is a cross sectional view of a score tool according to one embodiment taken along line C-C of the embodiment in FIG. 14A wherein area "Z" of the embodiment in FIG. 14C is shown in detail.

Referring now to FIG. 14D, a detailed cross sectional view of area "Z" of the score tool in FIG. 14C is provided. A rivet diameter 190 is provided, which in this embodiment may be between approximately 0.137 inches to 0.139 inches. The rivet offset 192 is the distance between the center of the rivet and the primary score, and in this embodiment, the rivet offset 192 may be approximately 0.077 inches. Finally, the edge of the rivet recess is chamfered. In this embodiment, the rivet chamfer 194 may be approximately 25°.

Referring now to FIG. 14E, a perspective view of the score tool 88 is provided that comprises the features described in FIG. 11 to FIG. 14D.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the disclosure.

Moreover, though the present disclosure has included description of one or more embodiments and certain variations and modifications, other variations and modifications are within the scope of the disclosure, e.g. the use of disposable components comprising some or all of the apparatus described herein, as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A container end closure with a peripheral curl adapted for interconnection to a neck of a container, comprising:

a central panel;

a pull tab comprising a nose and a tail, said pull tab adapted for applying a downward force on a predetermined portion of said central panel;

a rivet operatively interconnecting said pull tab to an upper surface of said central panel and allowing said pull tab to rotate;

a first opening portion at least partially defined by a first severable score line;

a second vent opening portion at least partially defined by a second severable score line, and wherein said second severable score line and said first severable score line are substantially oriented along a common line, wherein said first opening portion and said second vent opening portion are positioned adjacent one another to form a larger combined opening; and a transition portion positioned between said first severable score line and said second severable score line which is adapted to inhibit propagation of a fracture from said first severable score line into said second severable score line, and wherein said nose of said pull tab can selectively move between a first position over said first opening portion and a second position over said second vent opening portion to facilitate opening of said first and second portions as said nose portion of said pull tab is pushed downward.

2. The container end closure of claim 1, wherein said transition portion is void of any score line.

3. The container end closure of claim 1, wherein said transition portion is a check slot having a length between an end of said first severable score line and an end of said second severable score line with a predetermined score residual which is distinct from a score residual of the first severable score line.

4. The container end closure of claim 3, wherein said score residual of said check slot is larger than said score residual of said first severable score line.

5. The container end closure of claim 3, wherein said length of said check slot is approximately 0.0140 inches.

6. The container end closure of claim 3, wherein a width of said check slot is between approximately 0.010 inches and 0.025 inches.

7. The container end closure of claim 1, further comprising:

an anti-fracture score positioned substantially parallel to said first severable score line on said first opening portion and positioned substantially parallel to said second severable score line on said second vent opening portion.

8. The container end closure of claim 1, wherein said central panel comprises a rotation guide deboss area adapted for limiting a rotation of said pull tab in a direction which is substantially parallel to said central panel.

9. A method of opening an end closure of a container with a first opening portion and a second vent opening portion, comprising:

positioning a pull tab, which is interconnected to a central panel of said end closure with a rivet, to a first opening position;

lifting a tail end of said pull tab to apply a first downward force on said first opening portion of said central panel to shear a first score line up to a transition portion and create a first opening in said central panel, wherein said first score line and said transition portion have distinct score residuals;

repositioning said pull tab to a second opening position; and lifting said tail end of said pull tab to apply a second downward force on said second vent opening portion to shear said transition portion positioned between said first score line and a second score line and to shear said second score line to form a second vent opening in said central panel, wherein said second severable score line is oriented in the same line as said first severable score, wherein said transition portion and said second score line have distinct score residuals, and wherein said first opening portion and said second vent opening portion are integrally interconnected to form an opening larger than either said first opening or said second vent opening.

10. The method of claim 9, wherein said transition portion is void of any score line.

11. The method of claim 9, wherein said transition portion is a check slot extending between an end of said first score line and an end of said second score line.

12. The method of claim 11, wherein a score residual of said check slot is larger than a score residual of said first severable score line.

13. The method of claim 9, wherein said first score line comprises a termination feature with a curved profile.

14. The method of claim 9, wherein said pull tab is repositioned by rotating said pull tab in a plane which is substantially parallel to said central panel.

15. The method of claim 9, wherein said central panel comprises a rotation guide deboss area adapted for limiting a rotation of said pull tab in a direction which is substantially parallel to said central panel.

16. The method of claim 9, further comprising:

repositioning said pull tab over an additional second vent opening portion by at least rotating or twisting said pull tab in a plane which is substantially parallel to said central panel, wherein a user may apply a downward force on said additional second vent opening to form an additional second vent opening in said central panel.

17. A container end closure with a peripheral curl adapted for interconnection to a neck of a container, comprising:

a central panel;

a pull tab comprising a nose and a tail, said pull tab adapted for applying a downward force on said central panel;

a rivet operatively interconnecting said pull tab to an upper surface of said central panel and allowing said pull tab to be repositioned between a primary position to open a primary opening portion and a second position to open a second vent opening portion;

said primary opening portion at least partially defined by a primary severable score line;

said second vent opening portion at least partially defined by a second severable score line; and a check slot positioned between said primary severable score line and said second severable score line which is adapted to inhibit propagation of a fracture from said primary severable score line into said second severable score line, said check slot is a score line having a score residual that is distinct from a score residual of said primary severable score line and a score residual of said second severable score line.

18. The container end closure of claim 17, wherein said second severable score line is an extension of said primary severable score.

19. The container end closure of claim 17, wherein said primary severable score line comprises a termination feature with a curved profile.

20. The container end closure of claim 17, wherein said score residual of said check slot is larger than said score residual of said primary severable score line.

* * * * *